US006262380B1

(12) United States Patent
Sasaki et al.

(10) Patent No.: US 6,262,380 B1
(45) **Date of Patent: *Jul. 17, 2001**

(54) SINGLE MANIPULATION UNIT SWITCHING DEVICE

(75) Inventors: Shunkichi Sasaki; Tatsushi Yonezawa, both of Kyoto (JP)

(73) Assignee: Omron Corporation, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/867,490

(22) Filed: Jun. 2, 1997

(30) Foreign Application Priority Data

Jun. 3, 1996 (JP) ..... 8-140206
Jun. 3, 1996 (JP) ..... 8-140207
Jun. 3, 1996 (JP) ..... 8-140208

(51) Int. Cl.[7] ..... H01H 1/58; H01H 15/00
(52) U.S. Cl. ..... 200/6 BB; 200/1 B; 200/522; 200/240
(58) Field of Search ..... 200/14, 103, 243, 200/240, 573, 533, 6 BB, 304, 302.1, 9, 522, 535, 542, 551, 560, 562, 563, 8 R, 1 B

(56) References Cited

U.S. PATENT DOCUMENTS 3,527,913 * 9/1970 Gionet ..... 200/6 BB X
4,179,644 12/1979 Vassos .
4,339,643 * 7/1982 Murmann ..... 200/6 BB X
4,609,795 * 9/1986 Lavigne et al. ..... 200/533 X
4,650,935 * 3/1987 Ootsuka et al. ..... 200/240 X
4,864,083 * 9/1989 Bittel ..... 200/1 V
5,289,047 2/1994 Broghammer .
5,349,143 * 9/1994 Houser ..... 200/1 V X
5,834,714 * 11/1998 Berger et al. ..... 200/1 B X

FOREIGN PATENT DOCUMENTS 41 22 747 C2 9/1992 (DE) .
41 14 854 A1 11/1992 (DE) .
40 38 787 C2 9/1993 (DE) .
753 398 10/1933 (FR) .

OTHER PUBLICATIONS

Communication from German Patent Office in relation to German application No. 197 22 709.0–34.

* cited by examiner

*Primary Examiner*—Renee Luebke
(74) *Attorney, Agent, or Firm*—Morrison & Foerster LLP

(57) ABSTRACT

Respective movable contacts of first and second switches are formed on branch portions of a single, resilient movable piece. Pressing portions of a manipulation shaft which is in link motion with a manipulation, lever push the branch portions of the movable piece at different manipulation positions, whereby the movable contacts are sequentially brought into contact with respective fixed contacts.

5 Claims, 24 Drawing Sheets

NEUTRAL STATE

NORMAL ROTATION STATE

REVERSE ROTATION STATE

SINGLE MANIPULATION UNIT SWITCHING DEVICE

BACKGROUND OF THE INVENTION

1. Field of the Invention

The present invention relates to a switching device and, more specifically, to a switching device suitably used for normal/reverse rotation switching, rotational speed switching, and the like typically in power tools such as an electric drill and an electric screwdriver.

2. Description of the Related Art

FIG. 29 shows a circuit configuration of the main part of a conventional trigger switch (switching device) which is used in a power tool such as an electric drill. FIG. 30 is its vertical sectional view, and FIG. 31 is its partially cutaway plan view.

The trigger switch is provided with the following components. A pair of changeover switches 73 and 74 operate in link motion to switch the connections of both terminals of a DC motor 51 for drill blade driving in response to a manipulation on a switching lever 50 for normal/reverse rotation switching of the DC motor 51. A brake switch 54 brakes the DC motor 51 by short-circuiting both terminals thereof when a manipulation lever (trigger) 53, which is pulled by fingers for drill blade rotary driving, is at the free position, i.e., non-manipulation position. A first switch 56 connects a DC power supply to the DC motor 51 via a FET 55 for rotational speed control. A second switch 57 short-circuits the DC motor 51 with the DC power supply to rotate the DC motor 51 at the maximum speed when the manipulation lever 53 is pulled to the full stroke. A diode 58 is also provided.

As shown in FIG. 30, the brake switch 54 is composed of a braking movable contact 61 mounted on a manipulation shaft 60 which is urged in the direction of arrow C by means of a return spring 59, a coil spring 62 for urging the movable contact 61 in the direction of arrow C, and top and bottom braking fixed contacts 63 and 64 which are mounted on a case. When the manipulation lever 53 is at the free position where it is not pulled by fingers in the direction of arrow D in FIG. 30, the braking movable contact 61 is in pressure contact with the braking fixed contacts 63 and 64, whereby the brake switch is on to brake the DC motor 51.

The first switch 56 is composed of a fixed contact 65 which is mounted on a top portion of the case and a movable piece 68 which is urged by a coil spring 66 so that a movable contact 67 is brought into pressure contact with the fixed contact 65. At the free position, the free end of the movable piece 68 is placed on a protrusion 60*b* at a top portion of a plunger 60*a* of the manipulation shaft 60, whereby the contacts 65 and 67 are separated from each other and hence the first switch 56 is in an off-state.

The second switch 57 is composed of a fixed switch 69 which is mounted on a bottom portion of the case and a movable piece 72 which is urged by a coil spring 70 so that a movable contact 71 is brought into pressure contact with the fixed contact 69. At the free position, the free end.of the movable piece 72 is placed on a protrusion 60*c* at a bottom portion of the plunger 60*a* of the manipulation shaft 60, whereby the contacts 69 and 71 are separated from each other and hence the second switch 57 is in an off-state.

The first and second changeover switches 75 and 76, which are linked with each other to operate to switch the connections of both terminals of the DC motor 51 in response to a switching manipulation on the switching lever 50, are composed of fixed contacts 75 and 76 connected to the respective terminals of the DC motor 51, changeover contacts 77 and 78 to effect a changeover operation in response to a manipulation on the switching lever 50, fixed contacts 79 and 80 connected to the positive side of the DC power supply, and fixed contacts 81 and 82 to be connected to the negative side of the DC power supply via the first switch 56 and the FET 55 or the second switch 57.

The switching lever 50 (manipulating section) is pivotable about a pivot 83 in accordance with a switching manipulation. As shown in FIGS. 30 and 31, a protrusion 84*a* of a changeover cam 84 (changeover section) which is provided with the changeover contacts 77 and 78 of the first and second changeover switches 73 and 74 is engaged with an end portion of the switching lever 50. In accordance with a switching manipulation on the switching lever 50 which acts on the changeover cam 84 via the protrusion 84*a*, the changeover cam 84 pivots about a pivot 85 which is different from the pivot 83 of the switching lever 50. As shown in FIG. 31, the fixed contacts 75, 76, and 79–82 of the first and second changeover switches 73 and 74 are disposed around the changeover cam 84. In FIG. 31, reference numerals 90 and 91 are a radiation plate and a screw, respectively.

FIGS. 32A–32C show connection states between the changeover contacts 77 and 78 of the changeover cam 84 and the fixed contacts 75, 76, and 79–82; FIG. 32A shows a neutral state, FIG. 32B shows a normal rotation state, and FIG. 32C shows a reverse rotation state.

When the switching lever 50 in in the neutral state, the changeover contacts 75 and 76 of the changeover cam 84 are respectively connected to only the fixed contacts 75 and 76 which are connected to the respective terminals of the DC motor 51. When switching in made from the neutral state to the normal rotation state by a switching manipulation on the switching lever 50, the changeover cam 84 rotates to connect the fixed contacts 75 and 79 (80) via the changeover contact 77 while connecting the fixed contacts 76 and 81 (82) via the changeover contact 78, to establish the intended normal rotation state. On the other hand, when the normal rotation state is selected by manipulating the switching lever 50 in the opposite direction, the changeover cam 84 rotates to connect the fixed contacts 75 and 81 (82) via the changeover contact 77 while connecting the fixed contacts 76 and 79 (80) via the changeover contact 78, to establish the intended reverse rotation state.

Next, the operation of the above conventional trigger switch will be described.

It is now assumed that, for instance, the changeover switches 73 and 74 are in the state of FIG. 32B, that is, the normal rotation state is selected by manipulating the switching lever 50.

First, at the free position where the manipulation lever 53 is not pulled by fingers at all, the brake switch 54 is on while the first and second switches 56 and 57 are off, as described above.

When the manipulation lever 53 is pulled from the free position, after a play stroke the braking movable contact 61 of the manipulation shaft 60 is separated from the braking fixed contacts 63 and 64 to turn off the brake switch 54. Then, the free end of the movable piece 68 of the first switch 56 goes over the protrusion 60*b* at the top portion of the plunger 60*a*, so that the movable contact 67 rotates to contact with the fixed contact 65 (see FIG. 33), to thereby turn on the first switch 56. Supplied with power in this manner, the DC motor 51 starts to rotate in the normal direction. Further, in accordance with the pulling stroke of the manipulation lever 53, a brush 88 which is provided in the plunger 60*a* of the manipulation shaft 60 slides on a resistor of a circuit board (not shown), whereby a current corresponding to a slide position is supplied to the DC motor 51 via the FET 55 for rotational speed control. Thus, the DC motor 51 rotates at a rotational speed corresponding to the pulling stroke of the manipulation lever 53.

When the pulling stroke of the manipulation lever 53 reaches a predetermined value, the free end of the movable piece 72 goes over the protrusion 60*c* at the bottom portion of the plunger 60*a* of the manipulation shaft 60, so that the movable contact 671 rotates to contact with the fixed contact 69, to thereby turn on the second switch 57. Since the DC motor 51 is short-circuited with the DC power supply, the DC motor 51 rotates at the maximum speed.

On the other hand, when pulling of the manipulation lever 53 is released, the return spring 59 causes the manipulation shaft 60 to move in the direction of arrow C to effect an operation opposite to that when the manipulation lever 53 is pulled. That is, after the second switch is turned off, the first switch 56 is turned off to cut off power from the power supply and then the brake switch 54 is turned on to short-circuit both terminals of the DC motor 51 to thereby brake it.

When the reverse rotation state is selected by the normal/reverse rotation switching lever 50, the DC motor 51 rotates in the reverse direction in a manner similar to the above.

In the conventional trigger switch described above, as shown in FIG. 30, the first and second switches 56 and 57 (main switch section) includes the two movable pieces 68 and 72, the two coil springs 66 and 70 for urging the movable pieces 68 and 72, a terminal board 89 for connecting and supporting the movable pieces 68 and 72. Having so large a number of parts, the first and second switches 56 and 57 are not easy to assemble and costly.

As described above, the mechanism for normal/reverse rotation switching of the DC motor 51 as a load is constituted of individual parts of the switching lever 50 (manipulating section) and the changeover cam 84 (changeover section) which rotates in response to a switching manipulation on the switching lever 50. Therefore, this mechanism requires a number of assembling steps and hence is costly.

Further, as shown in FIG. 31, the radiation plate 90 for radiating heat from the FET 55 (heat generating element) is closely fixed to the FET 55 (located inside the case) by fastening with the screw 91 though an opening of the case. This mechanism is not easy to assemble either and requires a screw for fastening.

SUMMARY OF THE INVENTION

The present invention has been made in view of the above circumstances in the art, and an object of the invention is therefore to reduce the number of parts and facilitate the assembling, thereby reducing the cost.

To attain the above object, the invention is constituted as follows.

According to the invention, in a switching device comprising a first switch for connecting or disconnecting a power supply to or from a load via a load control element in accordance with a manipulation on a manipulation lever, and a second switch for connecting or disconnecting the power supply to or from the load not via the load control element in accordance with a manipulation on the manipulation lever, there are provided a single, resilient movable piece having respective movable contacts of the first and second switches which contacts are formed by making the movable piece branch off; and a manipulation member being connected to the manipulation lever, for bringing the movable contacts to or separated from corresponding fixed contacts, respectively. The movable piece may have first and second branch portions on which the movable contacts of the first and second switches are provided, and the manipulation member may have first and second pressing portions for bringing the movable contacts into contact with the respective fixed contacts at different manipulation positions of the manipulation lever by pushing the first and second branch portions, respectively, against a resilient force of the movable piece.

The first pressing portion may cause the movable contact on the first branch portion to start contacting the corresponding fixed contact when the manipulation lever is manipulated to a first manipulation position, and cause the movable contact on the second branch portion to start contacting the corresponding fixed contact when the manipulation lever in further manipulated to a second manipulation position.

There may be provided a brake switch having a braking movable contact which is constituted of a single member incorporated in the manipulation member, for short-circuiting both terminals of the load; and urging means for return-urging the manipulation lever in a direction opposite to a manipulation direction at an initial position where the manipulation lever is not manipulated, to thereby bringing the member into pressure-contact with a corresponding braking fixed contact.

The manipulation member may have a separating portion for forcibly separating fused contacts of the first and/or second switch in a return movement of the manipulation member.

The movable piece may have first and second branch portions on which the movable contacts of the first and second switches are provided, and the manipulation member may have first and second holding portions for separating the movable contacts from the respective fixed contacts by holding the first and second branch portions, respectively, against a resilient force of the movable piece, the first and second holding portions allowing the movable contacts to contact the respective fixed contacts at different manipulation positions of the manipulation lever by canceling the holding.

The holding by the first holding portion may be canceled to cause the movable contact on the first branch portion to start contacting the corresponding fixed contact when the manipulation lever is manipulated to a first manipulation position, and the holding by the second holding portion may be canceled to cause the movable contact on the second branch portion to start contacting the corresponding fixed contact when the manipulation lever is further manipulated to a second manipulation position.

The manipulation member may have first and second pressure increasing portions for increasing contact pressures of the movable contacts being in contact with the respective fixed contacts by pushing the first and second branch portions, respectively.

There may be provided a brake switch having a braking movable contact which is constituted of a single terminal member incorporated in the manipulation member, for short-circuiting circuiting both terminals of the load; and urging means for return-urging the manipulation lever in a direction opposite to a manipulation direction, i.e., toward a braking fixed contact, wherein at an initial position where the manipulation lever is not manipulated the terminal member in a return posture is in pressure-contact with a corresponding braking fixed contact, and wherein the braking movable contact makes a transition in accordance with a manipulation on the manipulation lever from the return posture to a manipulated posture in which the braking movable contact is separated from the braking fixed contact, a contact state between the braking movable and fixed contacts being maintained during the transition.

There may be provided a switching lever for switching between forward rotation and reverse rotation of the load by switching connections between power supply side terminals and load side terminals, the switching lever rotating about a pivot in accordance with a switching manipulation and having first and second changeover contact portions urged in directions in which they go away from each other; first and second fixed contact portions, provided in each of the load side terminals (or each of the power supply side terminals), with or from which the first and second changeover contact portions are brought into contact or separated, respectively, by rotating in accordance with the switching manipulation; a first fixed contact portion of one terminal of the power supply side terminals (or the load side terminals) being brought into contact with or separated from the above first fixed contact portion via the first changeover contact portion in accordance with the switching manipulation, and a second fixed contact portion of the other terminal of the power supply side terminals (or the load side terminals) being brought into contact with or separated from the above second fixed contact portion via the second changeover contact portion in accordance with the switching manipulation; and convex portions which are provided in the first fixed contact portions with or from which the first changeover contact portion is brought into contact or separated or the second fixed contact portions with or from which the second changeover contact portion is brought into contact or separated, and which project against an urging force of the first or second changeover contact portion of the switching lever.

The first or second fixed contact portions which are not formed with the convex portions are so disposed as to be separated from the first and second changeover contact portions of the switching lever at a neutral position where neither the normal rotation nor the reverse rotation is selected.

There may be provided an element which generates heat; and a radiation plate for radiating the heat generated by the elements, the radiation plate having an insertion hole in which one end portion of a terminal accommodated in a case is inserted, the one end portion of the terminal being inserted in a hole of the element, the one end portion of the terminal being caulked in a state of being inserted in the insertion hole of the radiation plate to thereby closely fix the terminal, the element, and the radiation plate to each other.

There may be provided a cover for covering the case, the cover having an opening through which the element is exposed to the outside, wherein the radiation plate is closely fixed to the element through the opening.

A manipulation member being connected to the manipulation lever, a circuit board on which a brush mounted on the manipulation member slides, and a terminal having an engagement protrusion and an engagement hole may be accommodated in the case, and the circuit board may be attached to the case by inserting and engaging the engagement protrusion into and with the engagement hole.

A sectioned dust prevention room may be provided in the case, the dust prevention room communicating with the insertion hole of the radiation plate which is closely fixed to the element.

The element may be an FET for controlling current flowing through the load in accordance with an manipulation on the manipulation lever, and the terminal having the caulked one end portion may be connected to the FET.

The invention can also be constituted as a switching device at least comprising a brake switch having a braking movable contact which is constituted of a single member incorporated in the manipulation member, for short-circuiting both terminals of the load; and urging means for return-urging the manipulation lever in a direction opposite to a manipulation direction at an initial position where the manipulation lever is not manipulated, to thereby bringing the braking movable contact into pressure-contact with a corresponding braking fixed contact.

The invention can also be constituted as a switching device at least comprising a switching lever for switching between forward rotation and reverse rotation of the load by switching connections between power supply side terminals and load side terminals in accordance with a switching manipulation, the switching lever rotating about a pivot in accordance with the switching manipulation, the switching lever having first and second changeover contact portions at opposite positions of the pivot; and first and second fixed contact portions, provided in each of the power supply side terminals or each of the load side terminals, with or from which the first and second changeover contact portions are brought into contact or separated, respectively, by rotating about the pivot in accordance with the switching manipulation.

The invention can also be constituted as a switching device at least comprising an element which generates heat; and a radiation plate for radiating the heat generated by the element, the radiation plate having an insertion hole in which one end portion of a terminal accommodated in a case is inserted, the one end portion of the terminal being inserted in a hole of the element, the one end portion of the terminal being caulked in a state of being inserted in the insertion hole of the radiation plate to thereby closely fix the terminal, the element, and the radiation plate to each other.

According to the switching device of the invention, the movable contacts of the first and second switch are constructed by making a single, resilient movable piece branch off. Therefore, the portion that is conventionally composed of five parts, i.e., two movable pieces, two coil springs for urging the respective movable pieces, and a terminal board for connecting and supporting the movable pieces can now be constituted only of the single movable piece. As a result, the number of parts is reduced and the ease of assembling is improved, whereby the cost can be reduced greatly.

The manipulation member separates the movable contacts from the fixed contacts by holding the first and second branch portions, respectively, against the resilient force of the movable piece. The manipulation member allows the movable contacts to contact the fixed contacts by canceling the holding at different manipulation positions of the manipulation lever. Therefore, the pulling amount of the manipulation lever can be reduced as compared to the configuration in which the movable contacts are brought into contact with the fixed contacts by pushing the first and second branch portions.

According to the switching device of the invention, the braking movable contact is constituted of a single resilient member or a single terminal member which is urged by the urging means for return-urging the manipulation lever. Therefore, compared to the conventional device in which the corresponding portion is constituted of two parts, i.e., a movable contact and a coil spring for urging the movable contact, the number of parts is reduced and the ease of assembling is improved, whereby the cost can further be reduced.

According to the switching device of the invention, the manipulation member has the separating portion. Therefore, even if contact portions of the first and/or second switches are fused together, they can forcibly be separated from each other in a return movement of the manipulation member.

According to the switching device of the invention, the first fixed contact portions with or from which the first changeover contact portion of the switching lever for switching between normal rotation and reverse rotation is brought into contact or separated, or the second fixed contact portions with or from which the second changeover contact portion is brought into contact or separated are formed with convex portions projecting against the urging force of the changeover contact portion. Therefore, a sufficient sense of clicking can be obtained when the changeover contact goes over the convex portions as the switching lever rotates.

The first or second fixed contact portions which are not formed with the convex portions are so disposed as to be separated from the first and second changeover contact portions of the switching lever at the neutral position. Therefore, current never flown through the load even if the manipulation lever is manipulated at the neutral position.

According to the switching device of the invention, one end portion of the terminal accommodated in the case is inserted in the hole of the radiating portion of the element, and the one end portion of the terminal is caulked in a state of being inserted in the insertion hole of the radiation plate to thereby closely fix the terminal, the element, and the radiation plate to each other. Therefore, unlike the conventional device in which the element and the radiation plate are fastened to each other with a screw, the element and the radiation plate can closely be fixed to each other by effectively using the terminal accommodated in the case without the need for a screw as a fastening member.

According to the switching device of the invention, the circuit board incorporated in the case has the engagement hole, and the circuit board is attached by inserting and engaging the engagement protrusion of the terminal into and with the engagement hole of the circuit board. Therefore, the circuit board can easily be attached through the above engagement even if during an attaching operation an urging force acts on the circuit board from the brush which slides on the circuit board in the direction opposite to the attaching direction.

Further, according to the switching device of the invention, the sectioned dust prevention room communicating with the insertion hole of the radiation plate is provided in the case. Therefore, even if dust or the like enters the case through the open portion of the insertion hole, it remains in the sectioned dust prevention room and hence causes no adverse effects an the switches in the case.

DESCRIPTION OF THE PREFERRED EMBODIMENTS

Embodiments of the present invention will be hereinafter described in detail with reference to the accompanying drawings.

Embodiment 1

Figure 1:
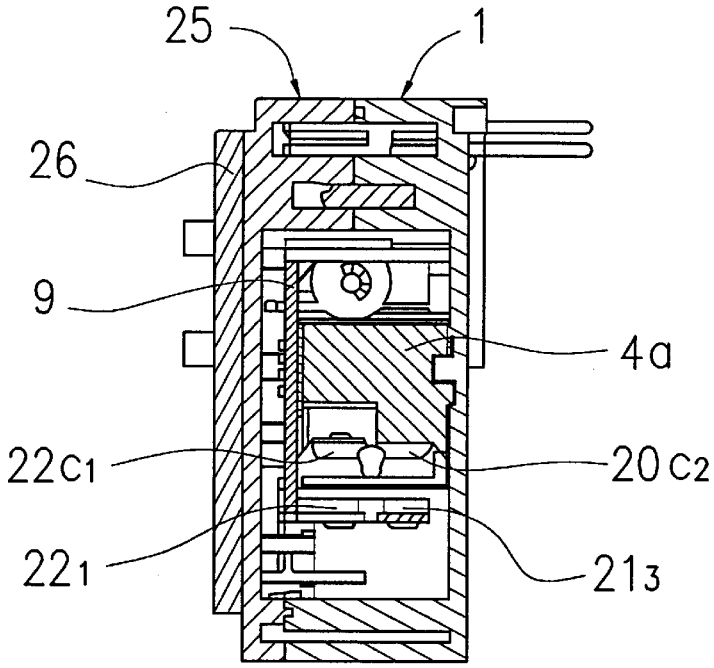
FIG. 1 is a sectional view of a trigger switch according to a first embodiment of the present invention.
Figure 2:
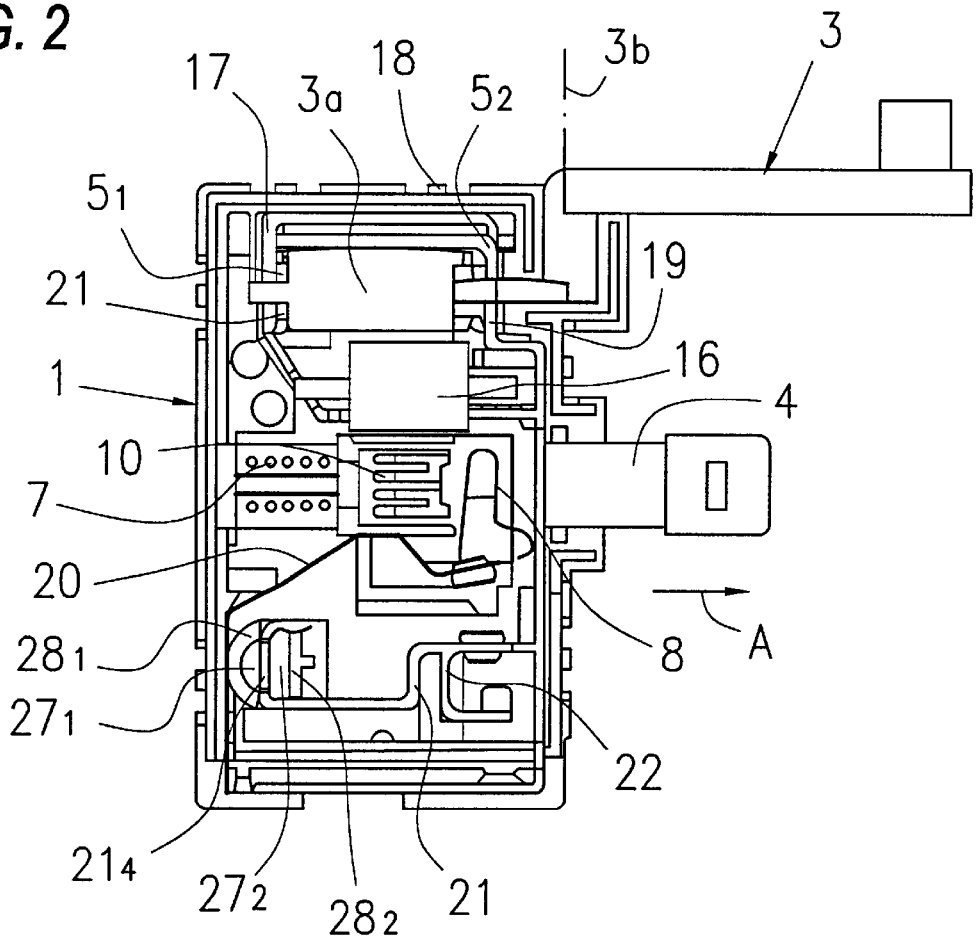
FIG. 2 is a side view of the trigger switch of FIG. 1 in a state that a radiation plate, a cover, etc. are removed.

FIG. 1 is a vertical sectional view of a trigger switch (switching device) according to a first embodiment of the invention. FIG. 2 is a side view of the trigger switch of FIG. 1 in a state that a radiation plate, a cover, etc. are removed.

Figure 3:
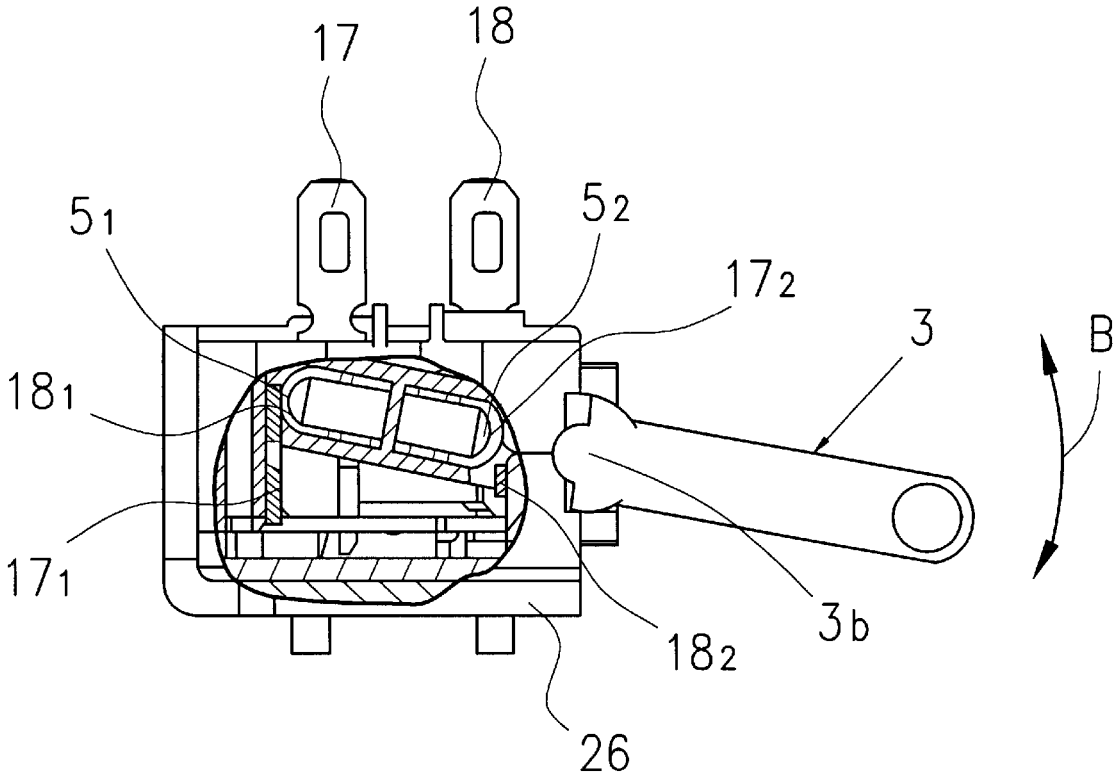
FIG. 3 is a partially cutaway plan view of the trigger switch of FIG. 1.
Figure 4:
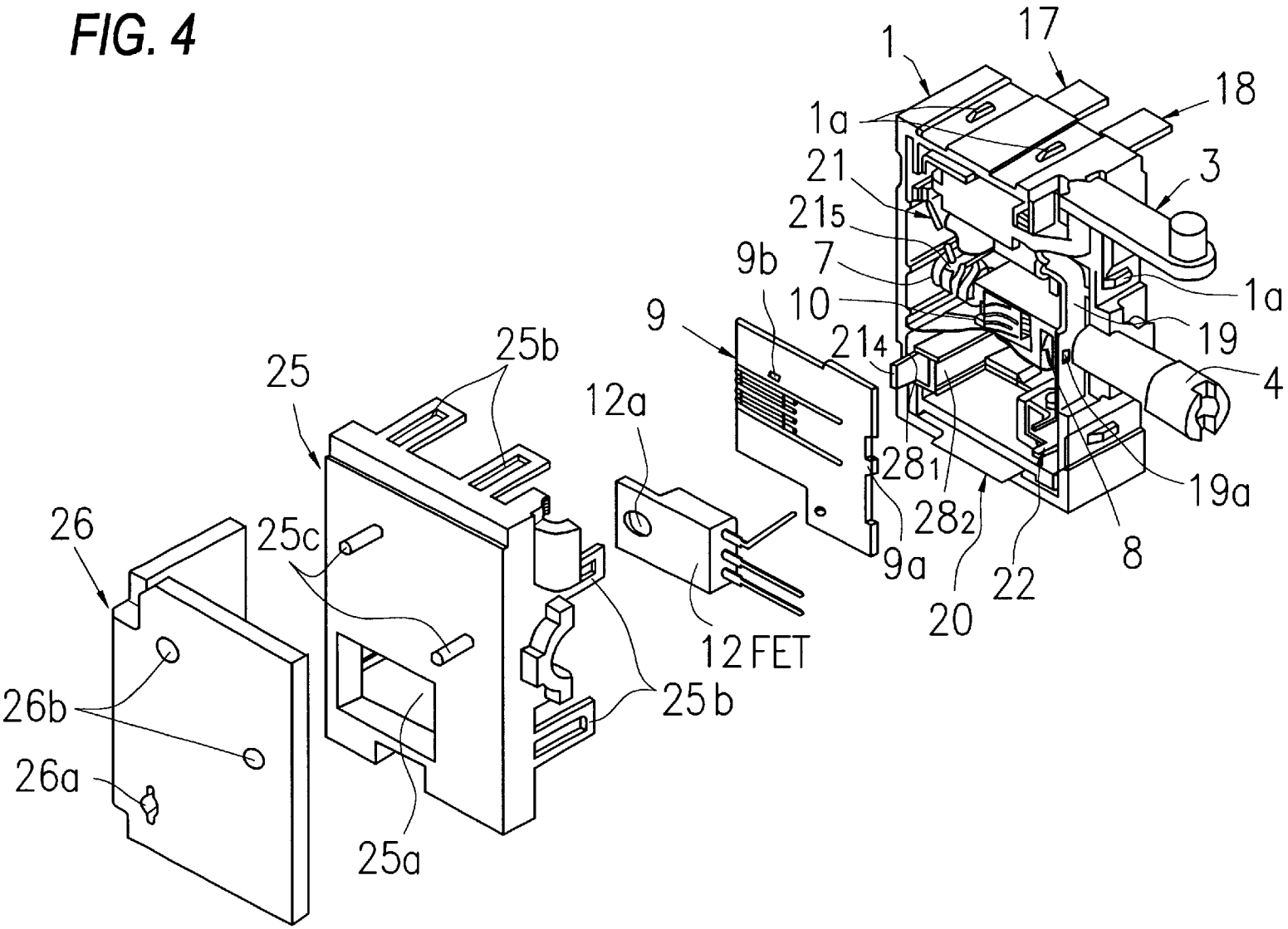
FIG. 4 is an exploded perspective view of the trigger switch of FIG. 1.
Figure 5:
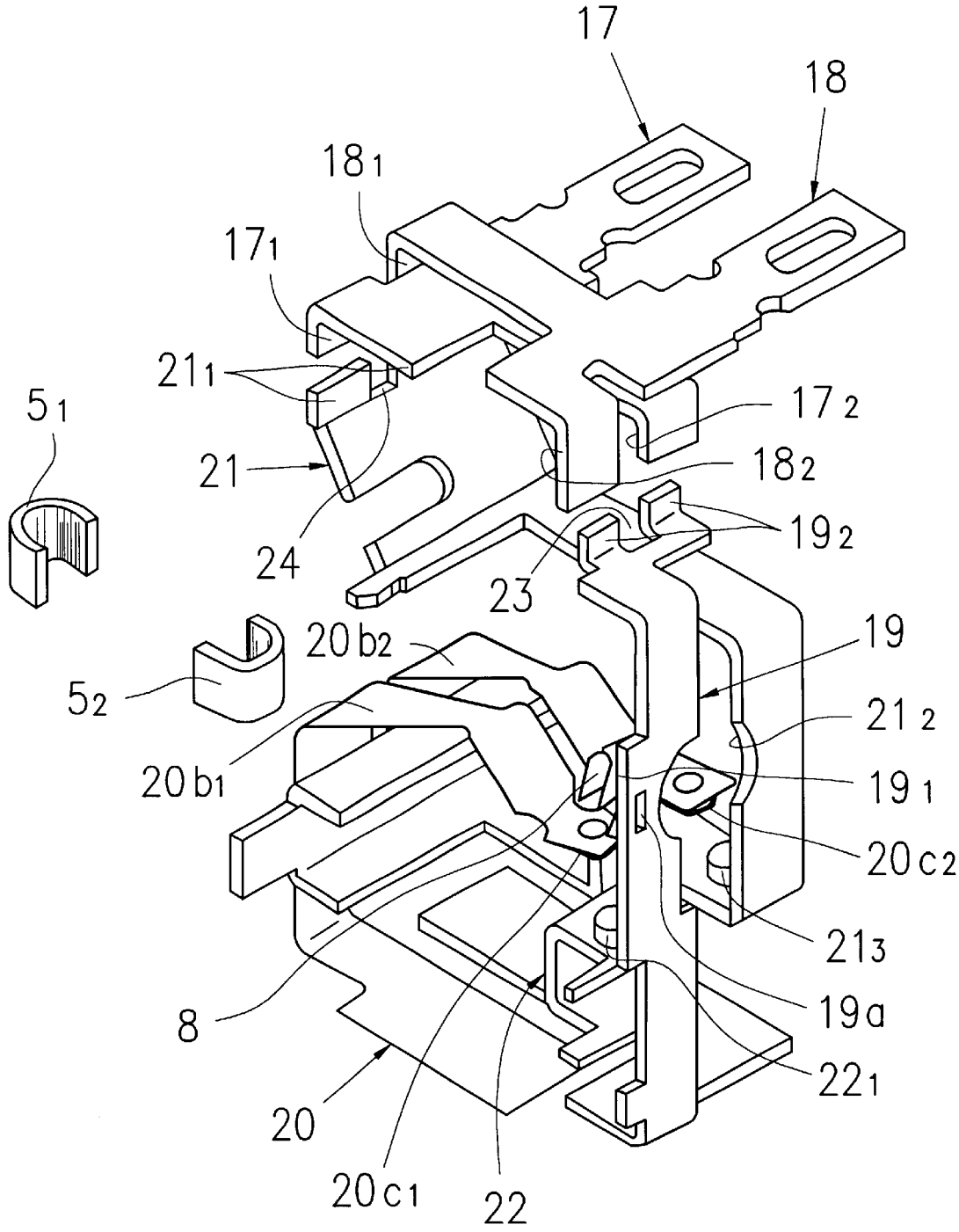
FIG. 5 is a perspective view showing the arrangement of a terminal section of the trigger switch of FIG. 1.
Figure 6:
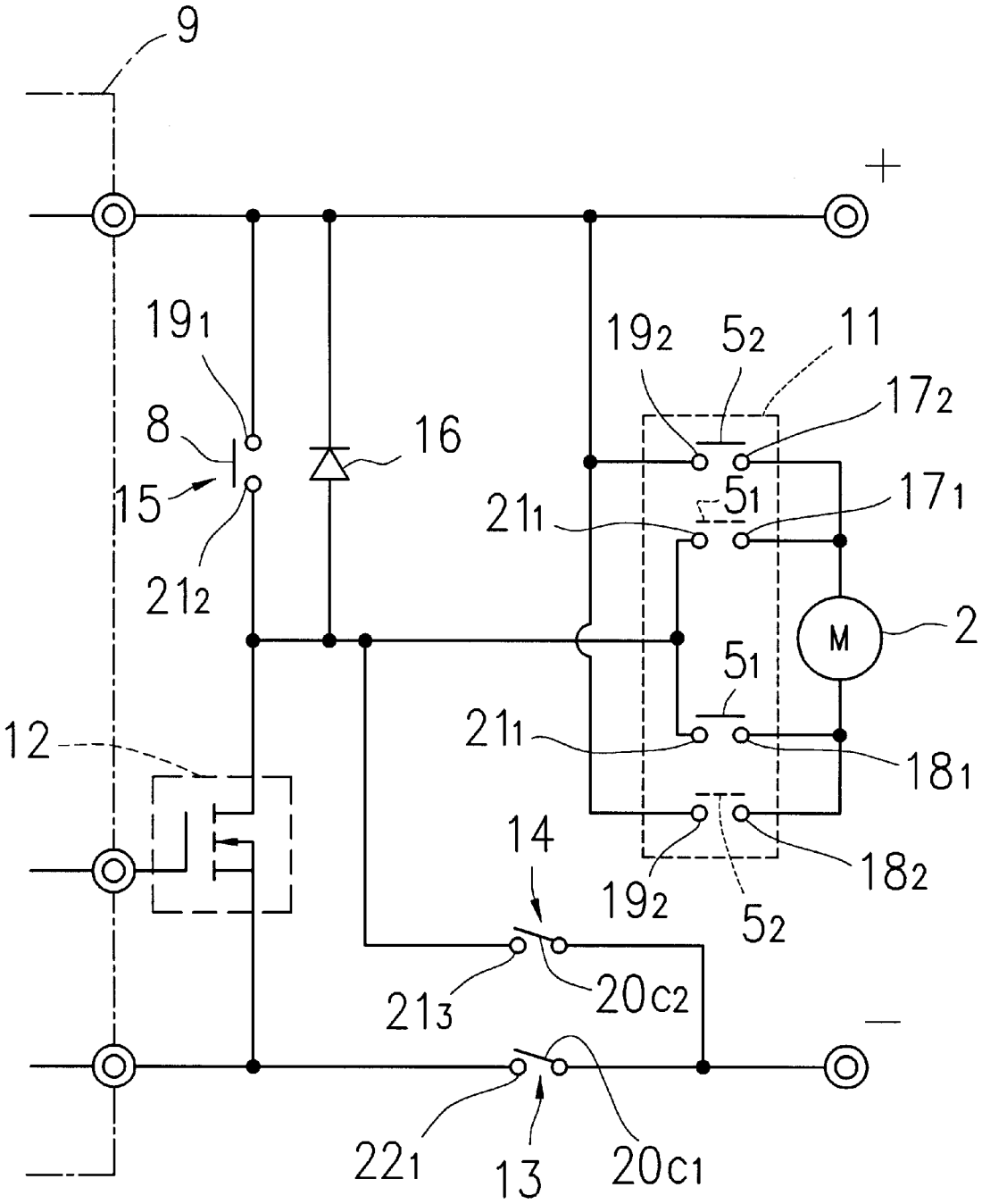
FIG. 6 shows a circuit configuration of the trigger switch of FIG. 1.

FIG. 3 is a partially cutaway plan view. FIG. 4 is an exploded perspective view. FIG. 5 is a perspective view showing the arrangement of a terminal section. FIG. 6 shows a circuit configuration.

For example, this trigger switch is used in an electric drill and performs normal/reverse rotation switching and rotational speed control. A switching lever 3 for normal/reverse rotation switching of a DC motor 2 for drill blade driving is provided at a top portion of a case 1. Provided under the switching lever 3 is a manipulation shaft 4 (manipulation member) which is connected to a manipulation lever (trigger; not shown) which is to be pulled by fingers for drill blade rotary driving.

Figure 7:
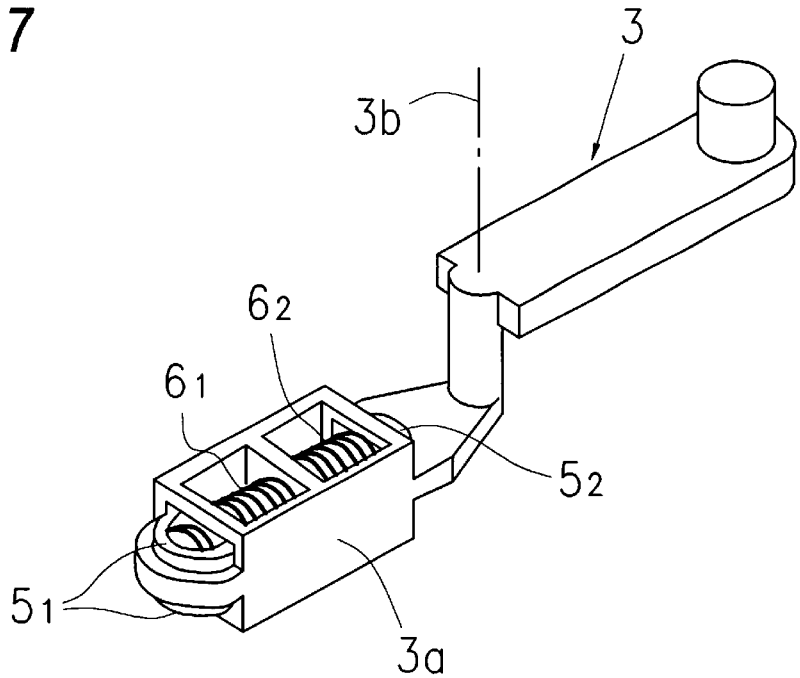
FIG. 7 is a perspective view of a switching lever.

One end portion of the switching lever 3 projects from the case 1 and serves as a manipulating section, and the other portion inside the case 1 is provided with first and second changeover contacts $\mathbf{5}_1$ and $\mathbf{5}_2$ and serves as a switching section. In contrast to the conventional example shown in FIG. 30, the single switching lever 3 constitutes both of the manipulating section and the changeover section. The first and second changeover contacts $\mathbf{5}_1$ and $\mathbf{5}_2$ switch the connections between the terminals on the DC motor 2 side and the terminals on the DC power supply side in response to a switching manipulation on the switching lever 3. As shown in FIGS. 3 and 5, each of the first and second changeover contacts $\mathbf{5}_1$ and $\mathbf{5}_2$ has a U-shape. As shown in FIG. 7, the first and second changeover contacts $\mathbf{5}_1$ and $\mathbf{5}_2$ and coil springs $\mathbf{6}_1$ and $\mathbf{6}_2$ for urging the contacts $\mathbf{5}_1$ and $\mathbf{5}_2$ in such directions that they go away from each other are accommodated in and held by an accommodating portion 3*a* of the end portion of the switching lever 3. The top and bottom portions of each of the changeover contacts $\mathbf{5}_1$ and $\mathbf{5}_2$ project from the accommodating portion 3*a* and are to be brought into contact with or separated from fixed contact portions (described later).

In response to a switching manipulation on the switching lever 3, the first and second changeover contacts $\mathbf{5}_1$ and $\mathbf{5}_2$ rotate together with the switching lever 3 about the same pivot 3*b* as the switching lever 3 does. Since the distances of the first and second changeover contacts $\mathbf{5}_1$ and $\mathbf{5}_2$ from the pivot 3*b* are different from each other, the first and second changeover contacts $\mathbf{5}_1$ and $\mathbf{5}_2$ rotate about the pivot 3*b* along concentric circles.

The manipulation shaft 4 which moves together with the manipulation lever (not shown) is return-urged in the direction of arrow A (see FIG. 2) by a return spring 7. The manipulation shaft 4 is provided with a brake terminal 8 as a movable contact of a brake switch (described later) and a brush 10 which slides on a resistor of a circuit board 9 in accordance with a manipulation amount of the manipulation lever.

As shown in the circuit diagram of FIG. 6, the trigger switch includes the following components. A normal/reverse rotation changeover switch 1 switches, connected to, the connections of both terminals of the DC motor 2 in response to a manipulation on the switching lever 3. A first switch 13 connects the DC power supply to the DC motor 2 via a FET 12 for rotational speed control in response to movement of the manipulation shaft 4 which is connected to the manipulation lever which is to be pulled by fingers for drill blade rotary driving. A second switch 14 short-circuits the DC motor 2 with the DC power supply to rotate the DC motor 2 at the maximum speed when the manipulation lever is pulled to the full stroke. A brake switch 15 brakes the DC motor 2 by short-circuiting both terminals thereof when the manipulation lever is at the free position, i.e., non-manipulation position. A diode 16 is also provided.

To constitute the circuit including the switches 11 and 13–15, and other elements, the following terminals are incorporated in the case 1 as shown in the terminal arrangement of FIG. 5. A first motor terminal 17 and a second motor terminal 18 are connected to the. respective terminals of the DC motor 2. A first terminal 19 is connected to the positive side of the DC power supply and a second terminal 20 is connected to its negative side. A third terminal 21 is connected to the drain of the FET 12 for rotational speed control and also to the second terminal 19 via the second switch 14. A fourth terminal 22 is connected to the source of the FET 12 and also to the second terminal 20 via the first switch 13. The above-mentioned brake terminal 8 serves as the movable contact of the brake switch 15.

The first motor terminal 17 has first and second fixed contact portions $\mathbf{17}_1$ and $\mathbf{17}_2$ with or from which the first and second changeover contacts $\mathbf{5}_1$ and $\mathbf{5}_2$ are brought into contact or separated in response to a switching manipulation on the switching lever 3. Similarly, the second motor terminal 18 has first and second fixed contact portions $\mathbf{18}_1$ and $\mathbf{18}_2$. The first and second fixed contact portions $\mathbf{17}_1$, $\mathbf{18}_1$, $\mathbf{17}_2$, and $\mathbf{18}_2$ are bent downward , and are arranged such that the first fixed contact portion $\mathbf{17}_1$ of the first motor terminal 17 is opposed to the second fixed contact portion $\mathbf{18}_2$ of the second motor terminal, that the second fixed contact portion $\mathbf{17}_2$ of the first motor terminal 17 is opposed to the first fixed contact terminal $\mathbf{18}_1$ of the second motor terminal 18, and that a predetermined gap is formed between the adjacent fixed contact portions, i.e., between the first fixed contact portions $\mathbf{17}_1$ and $\mathbf{18}_1$ and between the second fixed contact portions $\mathbf{17}_2$ and $\mathbf{18}_2$.

The first terminal 19 which is connected to the positive side of the DC power supply has, at its top, two second fixed contact portions $\mathbf{19}_2$ which correspond to the second fixed contact portions $\mathbf{17}_2$ and $\mathbf{18}_2$ of the respective motor terminals 17 and 18. A cut 23 having a predetermined width in formed between the two second fixed contact portions $\mathbf{19}_2$ so that the second fixed contact portions $\mathbf{19}_2$ are arranged so as to correspond to the second fixed contact portions $\mathbf{17}_2$ and $\mathbf{18}_2$ of the respective motor terminals 17 and 18. The second fixed contact portions $\mathbf{19}_2$ of the first terminal 19 are brought into contact with or separated from the second fixed contact portions $\mathbf{17}_2$ and $\mathbf{18}_2$ of the first and second motor terminals 17 and 18, respectively, via the second changeover contact $\mathbf{5}_2$ of the switching lever 3 in response to a switching manipulation on the switching lever 3. The first terminal 19 has a braking fixed contact portion $\mathbf{19}_1$ with or from which the brake terminal 8 which is mounted on the manipulation shaft 4 is brought into contact or separated. The first terminal 19 also has a fixing hole 19*a* into which a fixing protrusion 9*a* which projects from the side face of the circuit board 9 are fitted when the circuit board 9 is attached (see FIG. 4).

The third terminal 21 which is connected to the negative side of the DC power supply via the FET 12 and the first switch 13 or the second switch 14 has, at its top, two first fixed contact portions $\mathbf{21}_1$ which correspond to the first fixed contact portions $\mathbf{17}_1$ and $\mathbf{18}_1$ of the respective motor terminals 17 and 18. A cut 24 having a predetermined width is formed between the two first fixed contact portions $\mathbf{21}_1$ so that the second fixed contact portions $\mathbf{21}_1$ are arranged so as to correspond to the first fixed contact portions $\mathbf{17}_1$ and $\mathbf{18}_1$ of the respective motor terminals 17 and 18. The first fixed contact portions $\mathbf{21}_1$ of the third terminal 21 are disposed under the first fixed contact portions $\mathbf{17}_1$ and $\mathbf{18}_1$ of the respective motor terminals 17 and 18 so as to be opposed to the second fixed contact portions $\mathbf{19}_2$ of the first terminal 19. The first fixed contact portions $\mathbf{21}_1$ of the third terminal 21 are brought into contact with or separated from the first fixed contact portions $17_1$ and $18_1$ of the first and second motor terminals 17 and 18, respectively, via the first changeover contact $5_1$ of the switching lever 3 in response to a switching manipulation on the switching lever 3. The third terminal 21 is bent to have a portion extending parallel with the first terminal 19, and the parallel portion has a braking fixed contact portion $21_2$ with or from which the brake terminal 8 which is mounted on the manipulation shaft 4 in brought into contact or separated. The third terminal 21 also has a second switch fixed contact $21_3$ which is part of the second switch 14 is formed on the top surface of a portion extending horizontally from the bottom end of the above-mentioned parallel portion.

Figure 8:
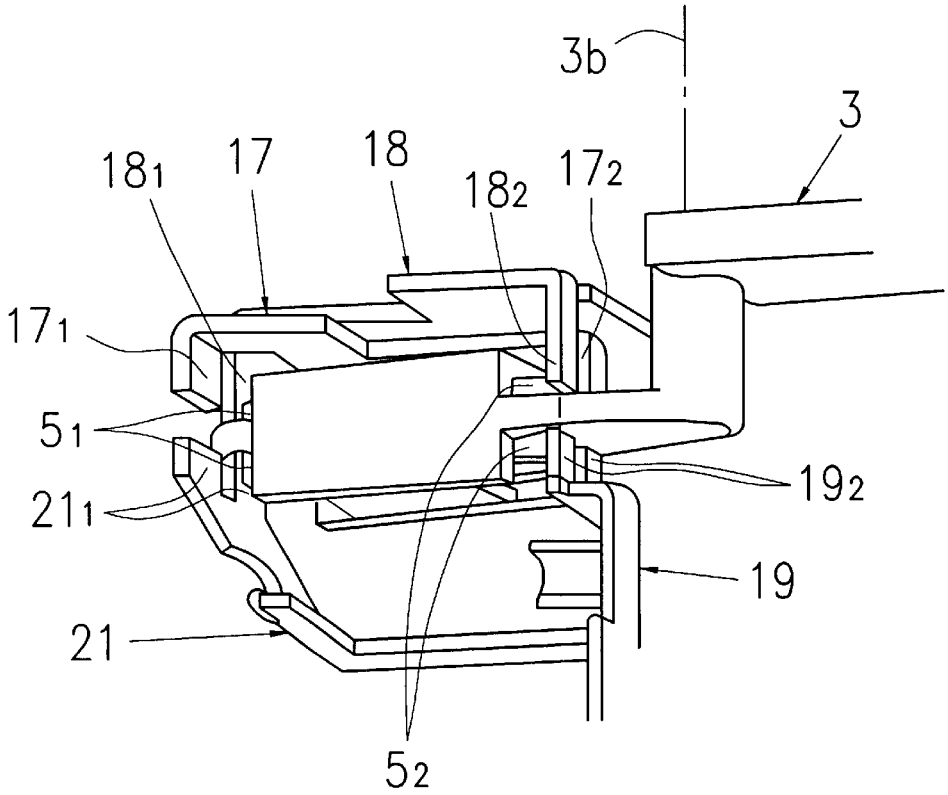
FIG. 8 is a perspective view illustrating a changeover operation with the switching lever.

The switching lever 3 is to be manipulated to one of the two sides as indicated by arrow B in FIG. 3 in accordance with whether to effect normal or reverse rotation. As shown in FIG. 8, the first and second changeover contacts $5_1$ and $5_2$ of the switching lever 3 are disposed between the upper first and second motor terminals 17 and 18 and the lower first and third terminals 19 and 21, and are brought into contact with or separated from the first and second fixed contact portions $17_1$, $18_1$, $17_2$ and $18_2$ of the first and second motor terminals 17 and 18 and the first and second fixed contact portions $21_1$ and $19_2$ of the third and first terminals 21 and 19.

The first fixed contact portion $17_1$ of the first motor terminal 17 and the second fixed contact portion $18_2$ of the second motor terminal 18 are disposed on one side in the manipulation direction of the switching lever 3, and the second fixed contact portion $17_2$ of the first motor terminal 17 and the first fixed contact portion $18_1$ of the second motor terminal 18 are provided on the other side in the manipulation direction of the switching lever 3. That is, the first and second contact portions $17_1$ and $17_2$ of the first motor terminal 17 and the first and second contact portions $18_1$ and $18_2$ of the second motor terminal 18 are arranged in a crossed manner.

With this arrangement, the connections for normal/reverse rotation switching can be effected in the following manner by means of the first and second changeover contacts $5_1$ and $5_2$ which rotate about the same pivot 3*b* as the switching lever 3 does.

Figure 9A:
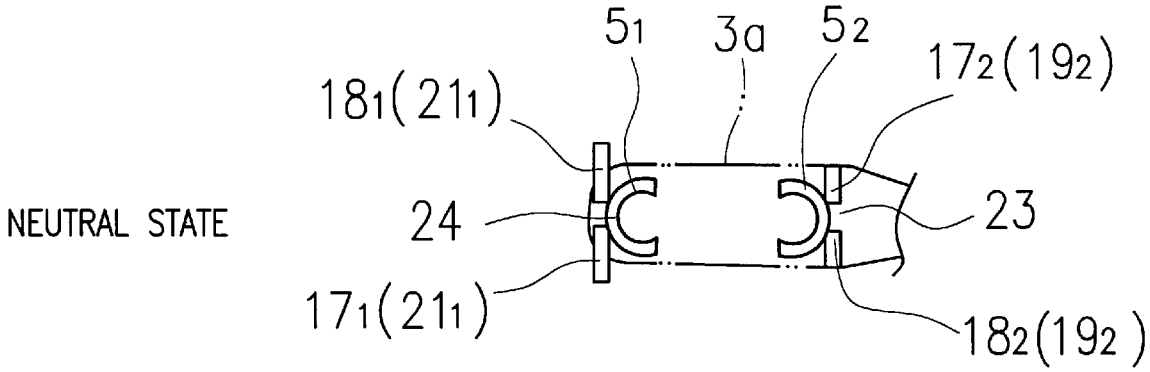
FIGS. 9A–9C show contact portions in a neutral state, a normal rotation state, and a reverse rotation state, respectively.
Figure 9B:
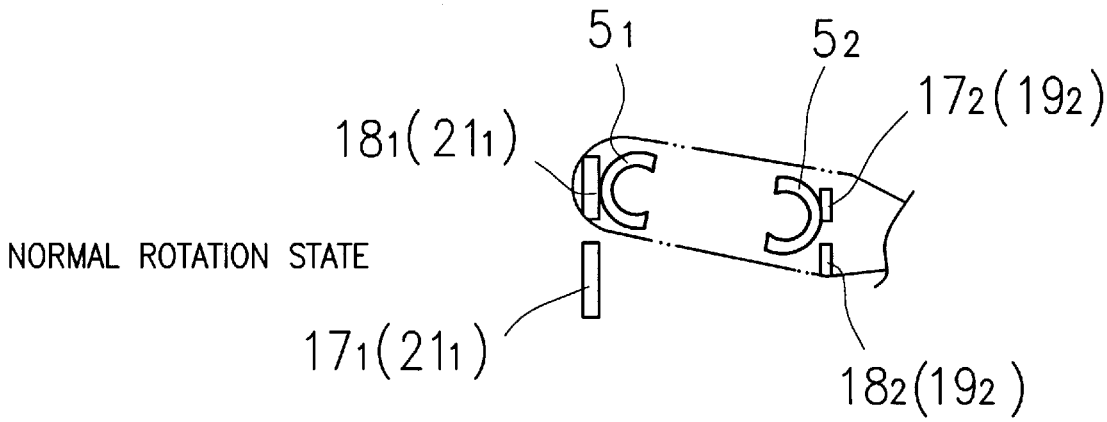
Figure 9C:
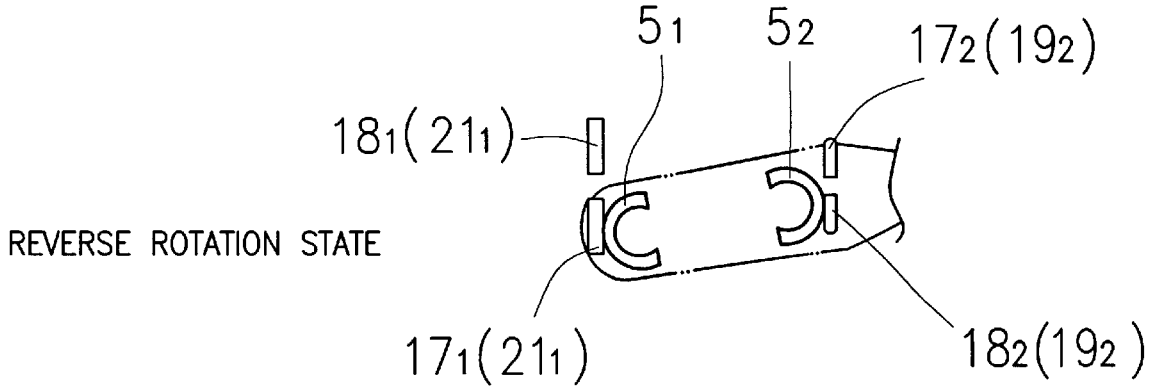

FIGS. 9A–9C are plan views showing the contact portions in a neutral state, a normal rotation state, and a reverse rotation state, respectively.

In the neutral state shown in FIG. 9A, part of the first changeover contact $5_1$ goes into the gap between the adjacent first fixed contact portions $17_1$ and $16_1$ of the first and second motor terminals 17 and 18, as well as into the cut 24 between the adjacent first fixed contact portions $21_1$ of the lower third terminal 21. On the other hand, part of the second changeover contact $5_2$ goes into the gap between the adjacent second fixed contact portions $17_2$ and $18_2$ of the first and second motor terminals 17 and 18, as well as into the cut 23 between the adjacent second fixed contact portions $19_2$ of the lower first terminal 19. If the normal rotation state of FIG. 9B is established by moving the switching lever 3 from the neutral position to one side, the first changeover contact $5_1$ is brought into contact with the first fixed contact portion $18_1$ of the second motor terminal 18 and the first fixed contact portion $21_1$ of the lower third terminal 21 which are disposed on the one side, and the second changeover contact $5_2$ is brought into contact with the second fixed contact portion $17_2$ of the first motor terminal 17 and the second fixed contact portion $19_2$ of the lower first terminal 19 which are disposed on the one side. Thus, the first motor terminal 17 is connected to the positive side of the DC power supply and the second motor terminal 18 is connected to its negative side via the FET 12 and the first switch 13 or the second switch 14.

If the reverse rotation state of FIG. 9C is established by moving the switching lever 3 from the neutral position if FIG. 9A to the other side, the first changeover contact $5_1$ is brought into contact with the first fixed contact portion $17_1$ of the first motor terminal 17 and the first fixed contact portion $21_1$ of the lower third terminal 21 which are disposed on the other side, and the second changeover contact $5_2$ is brought into contact with the second fixed contact portion $18_2$ of the second motor terminal 18 and the second fixed contact portion $19_2$ of the lower first terminal 19 which are disposed on the other side. Thus, the first motor terminal 17 is connected to the negative side of the DC power supply via the FET 12 and the first switch 13 or the second switch 14 and the second motor terminal 18 is connected to its positive side.

Figure 30:
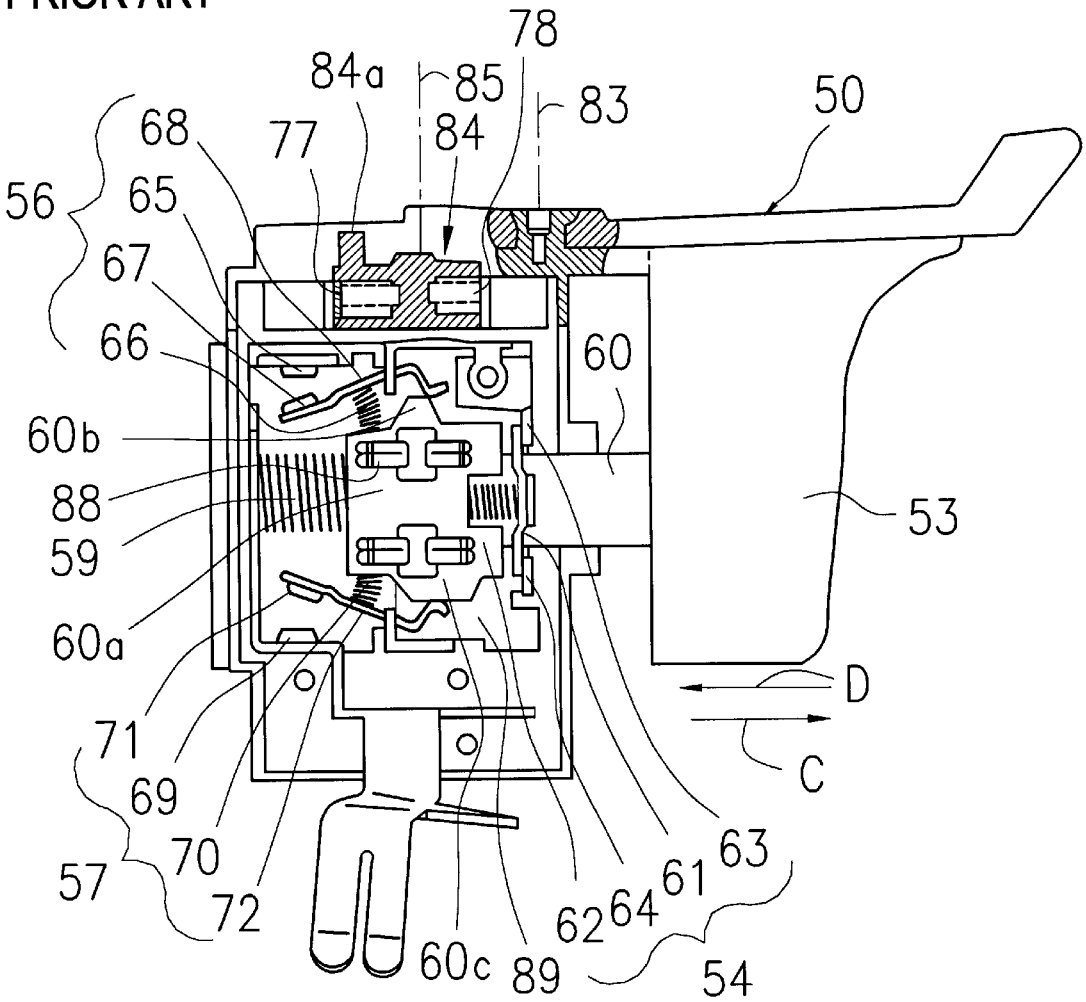
FIG. 30 PRIOR ART
FIG. 30 is a vertical sectional view of the conventional trigger switch.
Figure 31:
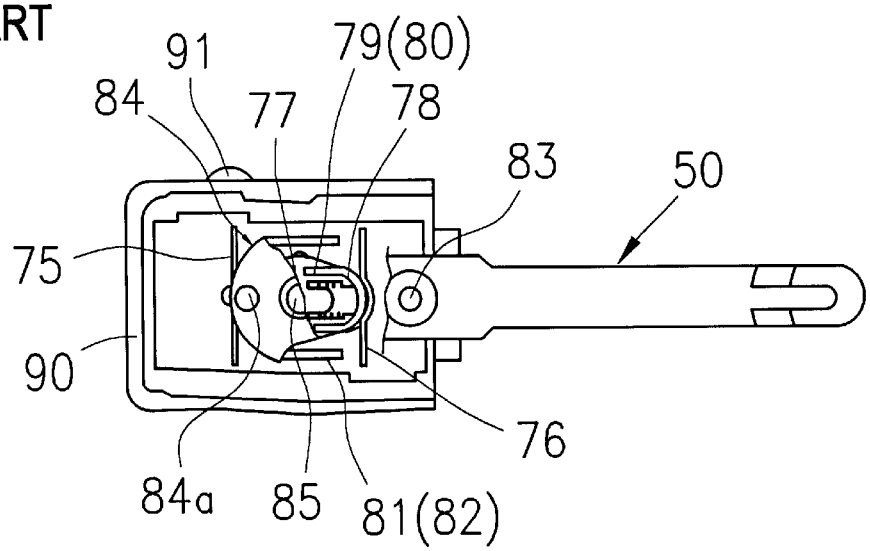
FIG. 31 PRIOR ART
FIG. 31 is a plan view of the conventional trigger switch in which a changeover cam is partially cut away.
Figure 32:
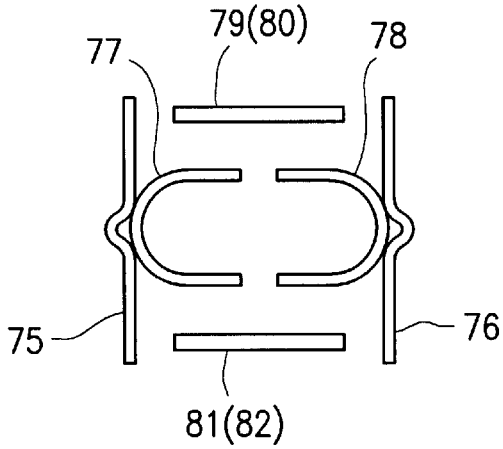
FIG. 32 (A) PRIOR ART
FIGS. 32A–32C show operation states of a switching lever of the conventional trigger switch.
Figure 32:
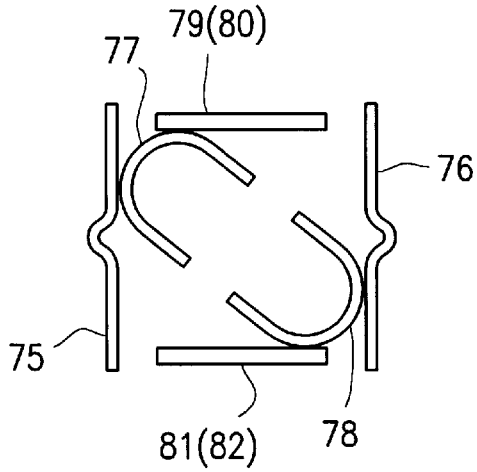
FIG. 32 (B) PRIOR ART
Figure 32:
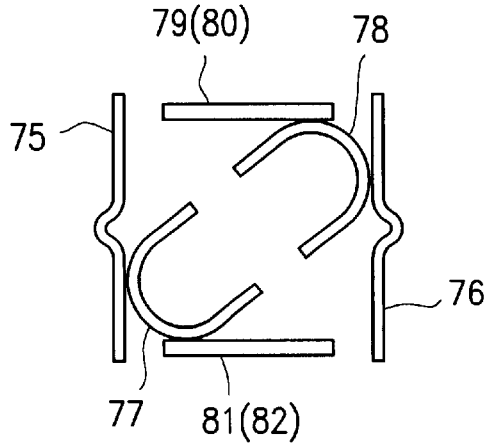
FIG. 32 (C) PRIOR ART
Figure 33:
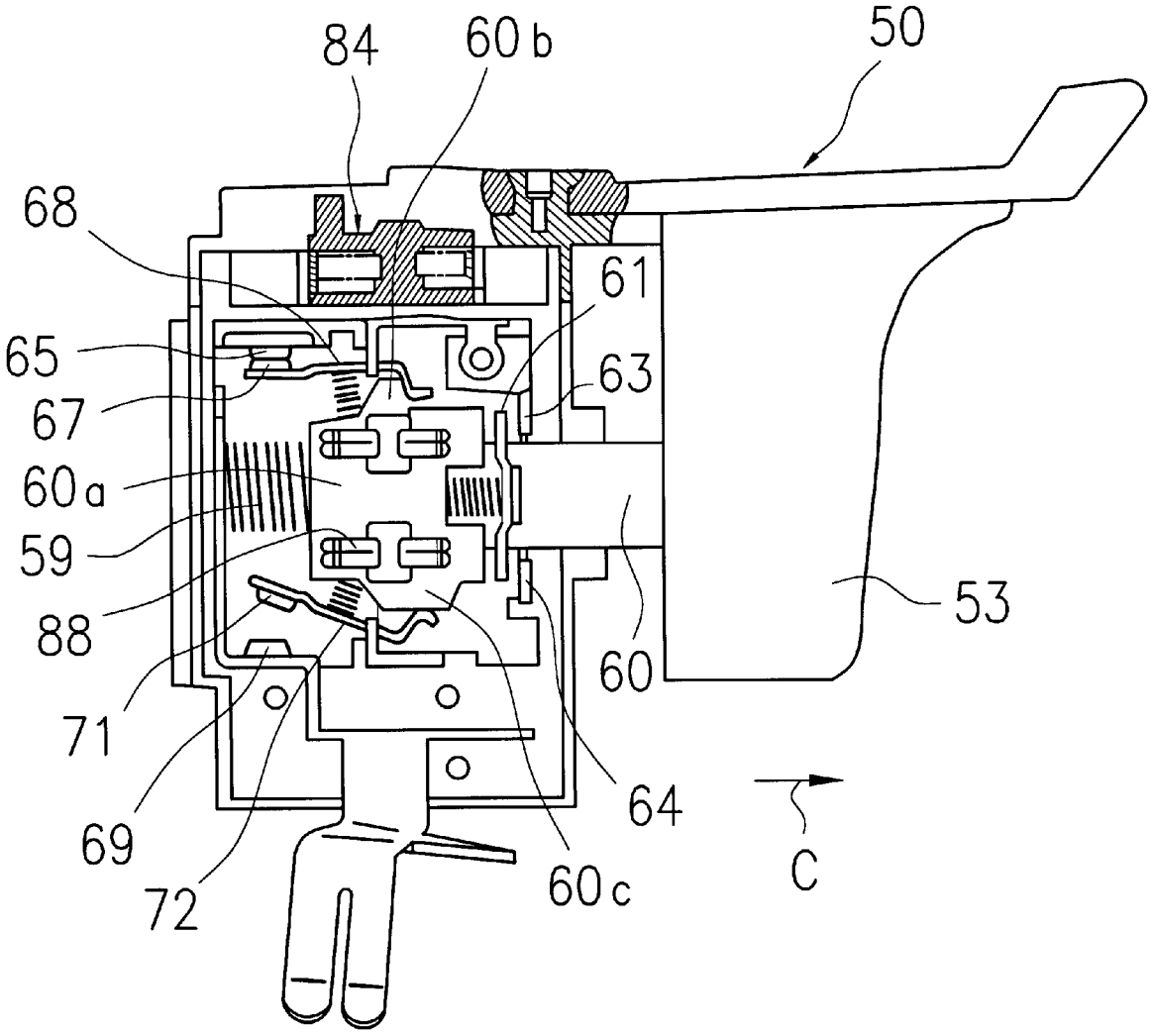
FIG. 33 PRIOR ART
FIG. 33 is a vertical sectional view corresponding to FIG. 30 and shows a state that a manipulation lever is pulled.

In the conventional trigger switch shown in FIG. 30, the mechanism for normal/reverse rotation switching of the DC motor 51 as a load is constituted of individual parts of the switching lever 50 (manipulating section) and the changeover cam 84 (changeover section) which rotates about the pivot 85 which in different from the pivot 83 of the switching lever 50 in response to a switching manipulation on the switching lever 50, as described above. In contrast, in the invention, both manipulating section and changeover section are constituted of only the switching lever 3; that is, the changeover cam 84 is not necessary any more. Accordingly, the number of parts in reduced and the ease of assembling is improved, whereby the cost can be reduced.

In addition, the first and second changeover contacts $5_1$ and $5_2$ of the switching lever 3 are urged to the first fixed contact portions $17_1$, $18_1$, and $21_1$ and the second fixed contact portions $17_2$, $18_2$, and $19_2$ by the coil springs $6_1$ and $6_2$, respectively. At the neutral position, part of the first changeover contact $5_1$ goes into the gap between the adjacent first fixed contact portions $17_1$ and $18_1$ of the first and second motor terminals 17 and 18 as well as into the cut 24 between the adjacent first fixed contact portions $21_1$ of the third terminal 21, and part of the second changeover contact $5_2$ goes into the gap between the adjacent second fixed contact portions $17_2$ and $18_2$ of the first and second motor terminals 17 and 18 as well as into the cut 23 between the adjacent second fixed contact portions $19_2$ of the first terminal 19. At this time, a user will have a sense of clicking. Since a sense of clicking can be obtained at the neutral position by the engaging operation that the first and second changeover contacts $5_1$ and $5_2$ go into the gaps between the adjacent first fixed contact portions $17_1$ and $18_1$ and between the adjacent second fixed contact portions $17_1$ and $18_2$ an and the cuts 24 and 23 between the adjacent first fixed contact portions $21_1$ and between the adjacent second fixed contact portions $19_2$, it is not necessary to provide separate parts to obtain a sense of clicking.

Although in this embodiment the first and second fixed an contact portions $17_1$ and $17_2$ of the first motor terminal 17 and the first and second fixed contact portions $18_1$ and $18_2$ of the second motor terminal 18 are arranged in a crossed manner on both sides in the manipulation direction of the switching lever 3, the invention is not limited to this case. As another embodiment of the invention, the shape and the arrangement of the first and second motor terminals 17 and 18 may be replaced by those of the first and third terminals 19 and 21 on the DC power supply side. That is, each of the first and third terminals 19 and 21 on the DC power supply side are formed with first and second fixed contact portions which are arranged in a crossed manner, and fixed contact portions of the first and second motor terminals 17 and 16 are arranged on the first changeover contact $\mathbf{5}_1$ side and the second changeover contact $\mathbf{5}_2$ side, respectively.

Figure 10:
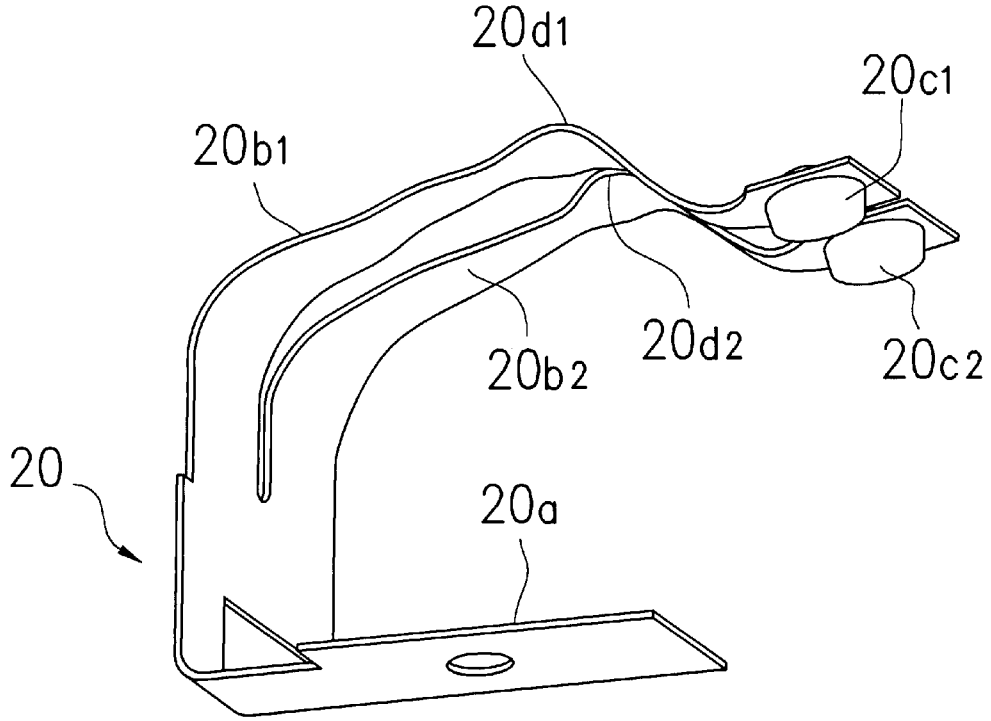
FIG. 10 is a perspective view of a movable piece.

The second terminal 20 which is connected to the negative side of the power supply is constituted of a single, resilient movable piece. As shown in FIG. 10, the movable piece 20 is so formed that a vertical portion extends from one end of a substrate portion 20*a* and branches off into two portions (first and second branch portions $\mathbf{20}b_1$ and $\mathbf{20}b_2$) which are opposed to the substrate portion 20*a*. A first switch movable contact $\mathbf{20}c_1$ and a second switch movable contact $\mathbf{20}c_2$ which are parts of the first and second switches 13 and 14, respectively, are formed on the bottom surfaces of free end portions of the first and second branch portions $\mathbf{20}b_1$ and $\mathbf{20}b_2$. The first and second branch portions $\mathbf{20}b_1$ and $\mathbf{20}b_2$ are also formed with bent touching portions $\mathbf{20}d_1$ and $\mathbf{20}d_2$ which are to touch the manipulation shaft 4 which is connected to the manipulation lever.

The first switch movable contact $\mathbf{20}c_1$ and the second switch movable contact $\mathbf{20}c_2$ of the second terminal 20 is accommodated in the case 1 so as to be opposed to a first switch fixed contact $\mathbf{22}_1$ of the fourth terminal 22 which contact is part of the first switch 13 and a second switch fixed contact $\mathbf{21}_3$ of the third terminal 21.

Figure 11:
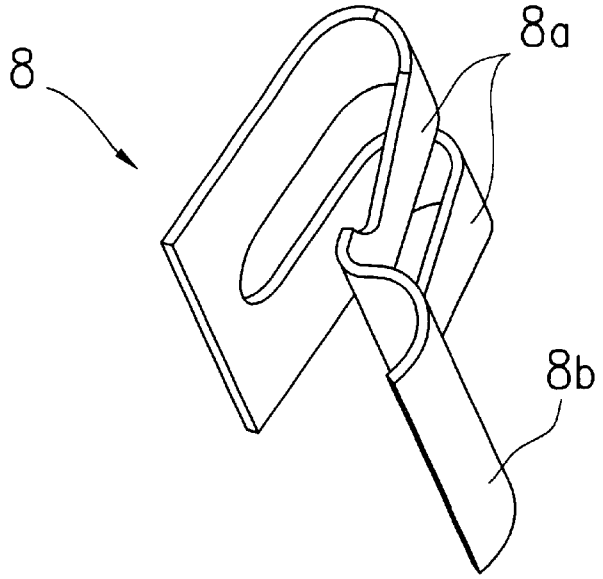
FIG. 11 is a perspective view of a brake terminal.

The brake terminal 8 is constituted of a single leaf spring. As shown in FIG. 11, the brake terminal 8 has a branched, bent portion 8*a* which is accommodated in an accommodating portion of the manipulation shaft 4 and a bent contact portion 8*b* which is to be brought into contact with or separated from respective braking fixed contact portions $\mathbf{19}_1$ and $\mathbf{21}_2$ of the first and third terminals 19 and 21. The brake terminal 8 is brought into contact with or separated from the braking fixed contact portion $\mathbf{19}_1$ of the first terminal 19 and the braking fixed contact portion $\mathbf{21}_2$ of the third terminal 21 in accordance with movement of the manipulation shaft 4 which is in link motion with the manipulation lever, to connect or disconnect the first and third terminals 19 and 21.

At the free position where the manipulation lever is not pulled at all, the brake terminal 8 is pressed against the respective braking fixed contact portions $\mathbf{19}_1$ and $\mathbf{21}_2$ of the first and third terminals 19 and 21 by the force of the return spring 7 which urges the manipulation shaft 4, against the resilient force of the brake terminal 8 itself. In this state, the brake terminal 8 is bent against its resilience. When the manipulation lever is pulled from the free position against the urging force of the return spring 7, the distance corresponding to the above bend serves as play. After the pulling stroke corresponding to the play, the brake terminal 8 is separated from the respective fixed contact portions $\mathbf{19}_1$ and $\mathbf{21}_2$.

In the conventional trigger switch shown in FIG. 30, the movable side is constituted of two parts, i.e., the braking movable contact 61 and the coil spring 62 for urging the movable contact 61. In contrast, in this embodiment, the movable side is constituted of a single part leaf spring. Accordingly, the number of parts is reduced and the ease of assembling is improved, whereby the cost can be reduced.

Figure 12:
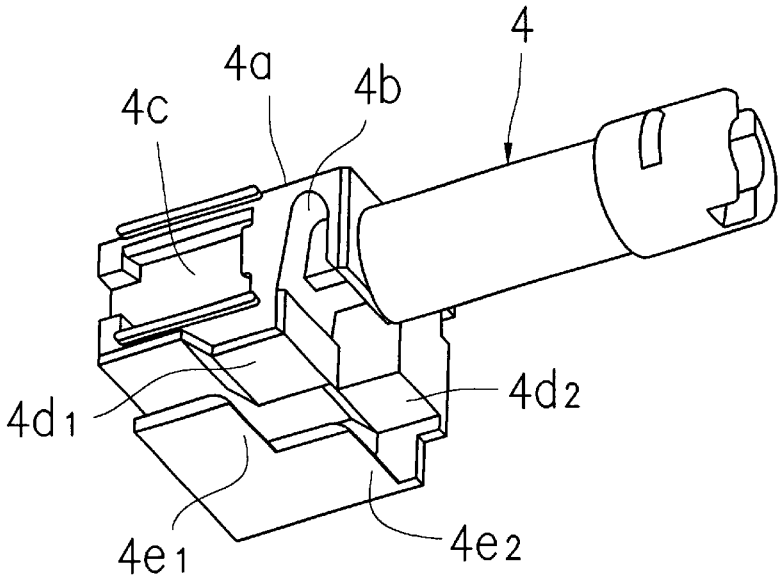
FIG. 12 in a perspective view of a manipulation shaft.

As shown in FIG. 12, the manipulation shaft 4, which is moved together with the manipulation lever which is to be manipulated by fingers for rotational driving of an electric drill, has a plunger 4*a*. The plunger 4*a* has a first accommodation recess 4*b* for accommodating the brake terminal 8 and a second accommodation recess 4*c* for accommodating the brush 10.

The plunger 4*a* of the manipulation shaft 4 has, in its bottom portion, first and second pressing portions $\mathbf{4}d_1$ and $\mathbf{4}d_2$ which push the first and second branch portions $\mathbf{20}b_1$ and $\mathbf{20}b_2$ of the second terminal 20, respectively, as the manipulation shaft 4 is moved, to thereby sequentially bring the movable contacts $\mathbf{20}c_1$ and $\mathbf{20}c_2$ into pressure contact with the first switch fixed contact $\mathbf{22}_1$ of the fourth terminal 22 and the second switch fixed contact $\mathbf{21}_3$ of the third terminal 21, respectively. The first and second pressing portions $\mathbf{4}d_1$ and $\mathbf{4}d_2$ are formed at different positions in the movement direction of the manipulation shaft 4 so as to turn on the first switch 13 when the manipulation lever is pulled to a first manipulation position, and then turn on the second switch 14 when the manipulation lever is pulled to a second manipulation position.

In the conventional trigger switch shown in FIG. 30, the movable side of the first and second switches 56 and 57 is constituted of the two movable pieces 68 and 72, the two coil springs 66 and 70 for urging the respective movable pieces 68 and 72, and the terminal board 89 for supporting the movable pieces 68 and 72. In contrast, in this embodiment, the movable side is constituted of the single movable piece having resilience. Accordingly, the number of parts is reduced and the ease of assembling is improved, whereby the cost can be reduced.

Further, in this embodiment, as shown in FIG. 12, plate-like first and second separating portions $\mathbf{4}e_1$ and $\mathbf{4}e_2$ are provided under the first and second pressing portions $\mathbf{4}d_1$ and $\mathbf{4}d_2$ of the manipulation shaft 4. The first and second separating portions $\mathbf{4}e_1$ and $\mathbf{4}e_2$ have a function of forcibly separating contacts of the first switch 13 and/or the second switch 14 which contacts are fused together, when the manipulation shaft 4 is returned. When contacts are fused together, the first and second separating portions $\mathbf{4}e_1$ and $\mathbf{4}e_2$ separate the first switch movable contact $\mathbf{20}c_1$ of the first branch portion $\mathbf{20}b_1$ and/or the second switch movable contact $\mathbf{20}c_2$ of the second branch portion and $\mathbf{20}b_2$ from the fixed contacts $\mathbf{22}_1$ and/or $\mathbf{21}_3$ by touching portions of the first and second branch portions $\mathbf{20}b_1$ and $\mathbf{20}b_2$ of the second terminal 20 close to the movable contacts $\mathbf{20}c_1$ and $\mathbf{20}c_2$ at different return positions in the movement direction of the manipulation shaft 4.

In the trigger switch having the above configuration, as a shown in FIG. 4, after the terminals 8 and 17–22, the switching lever 3, the manipulation shaft 4, and other parts are incorporated in the case 1, first the circuit board 9 is attached to the case 1, then the FET 12 is attached such that a bottom end portion $\mathbf{21}_4$ of the third terminal 21 is inserted into a hole 12*a* of a radiation portion of the FET 12, then a cover 25 having an opening 25*a* corresponding to the FET 12 in attached, and finally a radiation plate 26 is attached such that the end portion $\mathbf{21}_4$ of the third terminal 21 is inserted into an insertion hole 26*a* of the radiation plate. The end portion $\mathbf{21}_4$ in caulked so that the third terminal 21, the FET 12, and the radiation plate 26 are closely fixed to each other to form an integral unit. Engaging portions 25*b*, which project from a flange portion of the cover 25, are engaged with protrusions la which are formed on an outer circumferential surface of the case 1 when the cover 25 is attached to the case 1. Further, pins 25*c* project from the cover 25 at positions above the opening 25*a* which correspond to fixing holes 26*b* of the radiation plate 26. To allow the third terminal 21, the FET 12, and the radiation plate 26 to be brought into close contact with each other by caulking the end portion $\mathbf{21}_4$ of the third terminal 21, the end portion $\mathbf{21}_4$ of the third terminal 21 has a projected insertion portion $\mathbf{21}_4a$ which is to be inserted into the hole 12*a* of the radiation portion of the FET 12 and the insertion hole 26*a* of the radiation plate 26 and opposed supporting portions $\mathbf{21}_4b$ for supporting the FET 12 etc. as the subjects of caulking, as shown in FIG. 13.

Since as described above the fixing is effected by what is called split caulking by means of the end portion $\mathbf{21}_4$ of the third terminal 21, the number of parts can be made smaller and the assembling becomes easier than in the conventional case in which the radiation plate etc. are fixed to each other with the screw.

Figure 13:
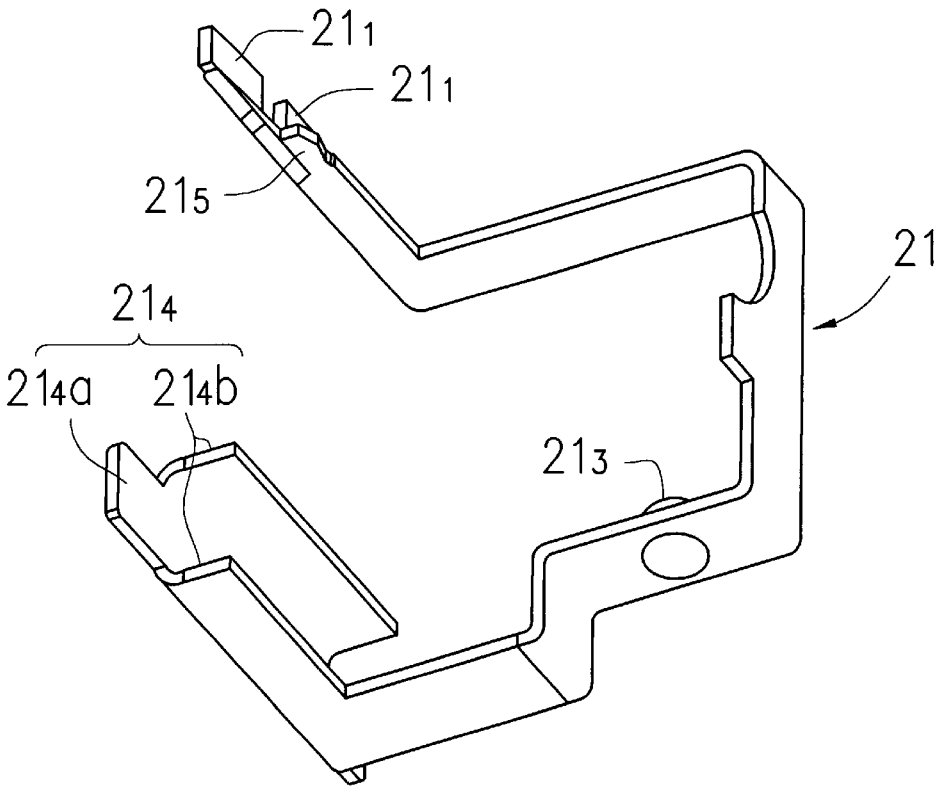
FIG. 13 is a perspective view of a third terminal.
Figure 14:
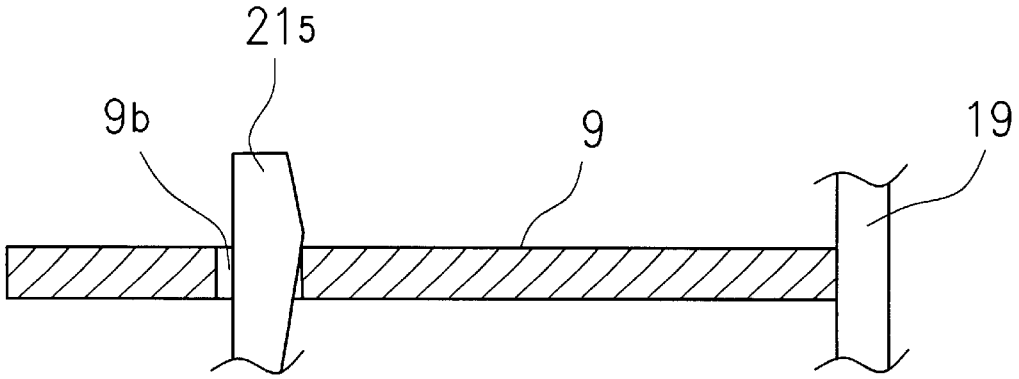
FIG. 14 is a sectional view showing show a circuit board is fixed.

Further, as shown in FIG. 13, the other end portion of the third terminal is formed with an engagement protrusion $\mathbf{21}_5$ which is to engage an engagement hole 9*b* which is formed at a peripheral portion of the circuit board 9 (see FIG. 4). When the circuit board 9 is incorporated into the case 1, it is urged by the brush 10 which is mounted on the manipulation shaft 4 in the direction opposite to the incorporating direction, so that it is difficult to align the circuit board 9. Conventionally, it is necessary to hold the circuit board by using a proper jig and hence it is not easy to incorporate the circuit board.

In this embodiment, a protrusion 9*a* formed on the side surface of the circuit board 9 is fitted into a fixing hole 19*a* of the first terminal 19 which is already incorporated in the case 1, and then the circuit board 9 is pushed down against the urging force of the brush 10, whereby the engagement hole 9*b* of the circuit board 9 is engaged with the engagement protrusion $\mathbf{21}_5$ of the third terminal 21 which has "<"-shaped slant faces and the circuit board 9 is held in place.

In this embodiment, the third terminal 21, the FET 12, and the radiation plate 26 are brought into close contact with each other by inserting the end portion $\mathbf{21}_4$ of the third terminal 21 which is incorporated in the case 1 into the insertion hole 26*a* of the radiation plate 26 which is disposed outside the case 1 and then performing what is called split caulking. Therefore, after the caulking, the inside and the outside of the case 1 communicate with each other through the gap between the insertion hole 26*a* of the radiation plate 26 and the end portion $\mathbf{21}_4$ of the third terminal 21, which means a possibility that dust etc. goes into the case 1 through the gap.

To solve this problem, in this embodiment, as shown in FIGS. 2 and 4, first and second isolation walls $\mathbf{28}_1$ and $\mathbf{28}_2$ are so formed as to communicate with the insertion hole 26*a* of the radiation plate 26 as the subject of caulking. The first and second isolation walls $\mathbf{28}_1$ and $\mathbf{28}_2$ and the third terminal 21 form two, i.e., first and second, dust prevention rooms $\mathbf{27}_1$ and $\mathbf{27}_2$ which are isolated from the other portions in the case 1. Therefore, even if dust enters the case 1 through the open portion of the insertion hole 26*a* of the radiation plate 26, it remains in the dust prevention rooms $\mathbf{27}_1$ and $\mathbf{27}_2$ and never influences the operations of the respective switches. Thus, there does not occur any erroneous operation due to entrance of dust.

Next, the operation of the above-configured trigger switch will be described.

First, at the free position in a normal rotation state, the switching lever 3 is moved to one side as described above and the changeover contacts $\mathbf{5}_1$ and $\mathbf{5}_2$ of the switching lever 3 are in the state shown in FIG. 9B. In this state, the changeover contact $\mathbf{5}_1$ of the switching lever 3 connects the first fixed contact portion $\mathbf{18}_1$ of the second motor terminal 18 to the first fixed contact portion $\mathbf{21}_1$ of the third terminal 21 and the changeover contact $\mathbf{5}_2$ connects the second fixed contact portion $\mathbf{17}_2$ of the first motor terminal 17 to the second fixed contact portion $\mathbf{19}_2$ of the first terminal 19. At the free position where the manipulation lever is not pulled at all, the manipulation shaft 4 is caused to be located at the initial position shown in FIG. 2 by the urging force of the return spring 7, and the brake terminal 8 which is incorporated in the plunger 4*a* of the manipulation shaft 4 is in pressure contact with the braking fixed contact portions $\mathbf{19}_1$ and $\mathbf{21}_2$ of the first and third terminals 19 and 21, whereby the terminals 19 and 21 are connected to each other to short-circuit both terminals of the DC motor 2. At the free position, the first and second pressing portions $\mathbf{4}d_1$ and $\mathbf{4}d_2$ of the plunger 4*a* of the manipulation shaft 4 do not push the upward-convex touching portions $\mathbf{20}d_1$ and $\mathbf{20}d_2$ of the first and second branch portions $\mathbf{20}b_1$ and $\mathbf{20}b_2$ of the movable piece (second terminal) 20, so that the first switch movable contact $\mathbf{20}c_1$ and the second switch movable contact $\mathbf{20}c_2$ are separated from the first switch fixed contact $\mathbf{22}_1$ of the fourth terminal 22 and the second switch fixed contact $\mathbf{21}_3$ of the third terminal 21, respectively. Thus, the first and second switches 13 and 14 are in off-states. That is, at the free position, while the brake switch 15 is on, both of the first and second switches 13 and 14 are off.

If the manipulation lever is pulled by fingers from the free position, in response the manipulation shaft 4 is moved leftward (in the direction opposite to the direction of arrow A) as viewed in FIG. 2. After a stroke of play which corresponds to the bend amount of the brake terminal 8, the brake terminal 8 which is mounted on the manipulation shaft 4 is separated from the braking fixed contact portions $\mathbf{19}_1$ and $\mathbf{21}_2$ of the first and third terminals 19 and 21 as shown in FIG. 15, to turn off the brake switch 15.

Figure 15:
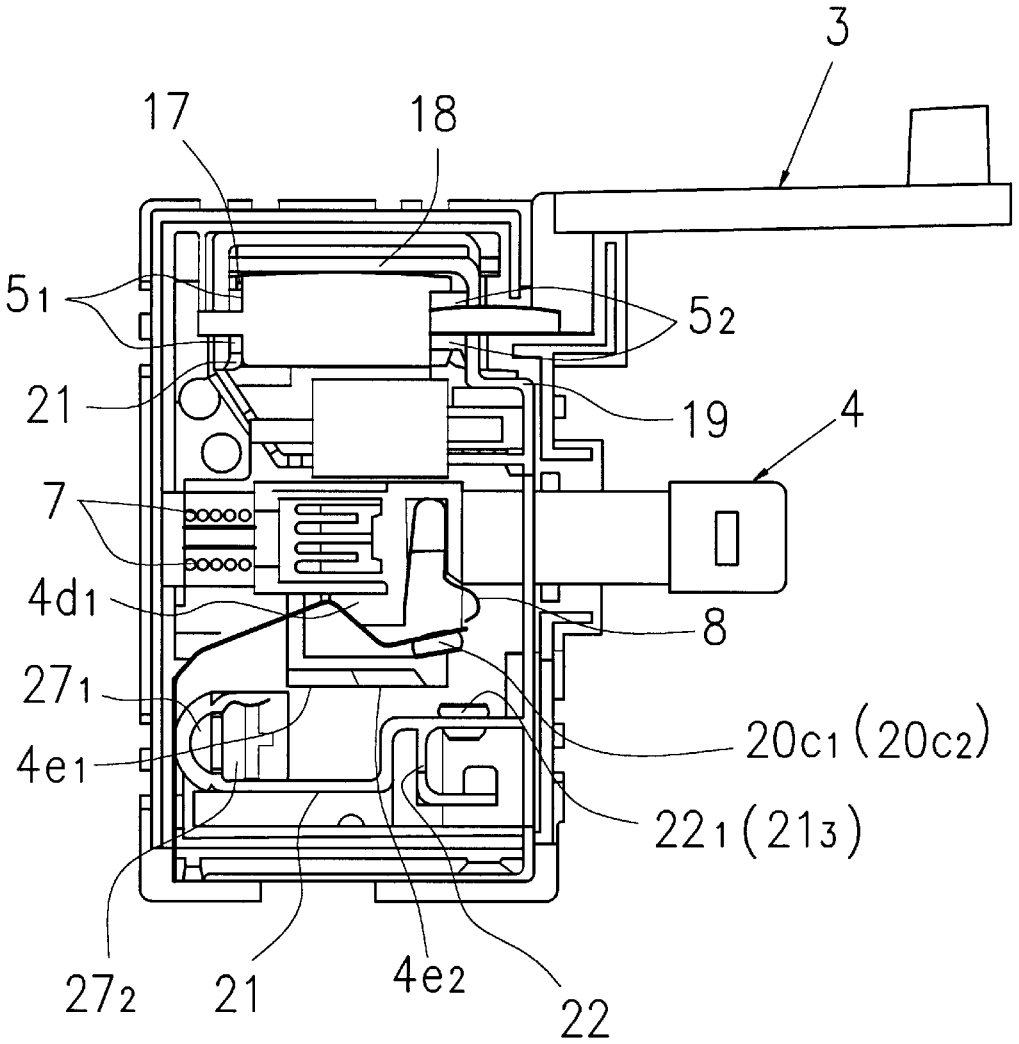
FIG. 15 is a side view corresponding to FIG. 2 and shows a state that a manipulation lever is pulled.
Figure 16:
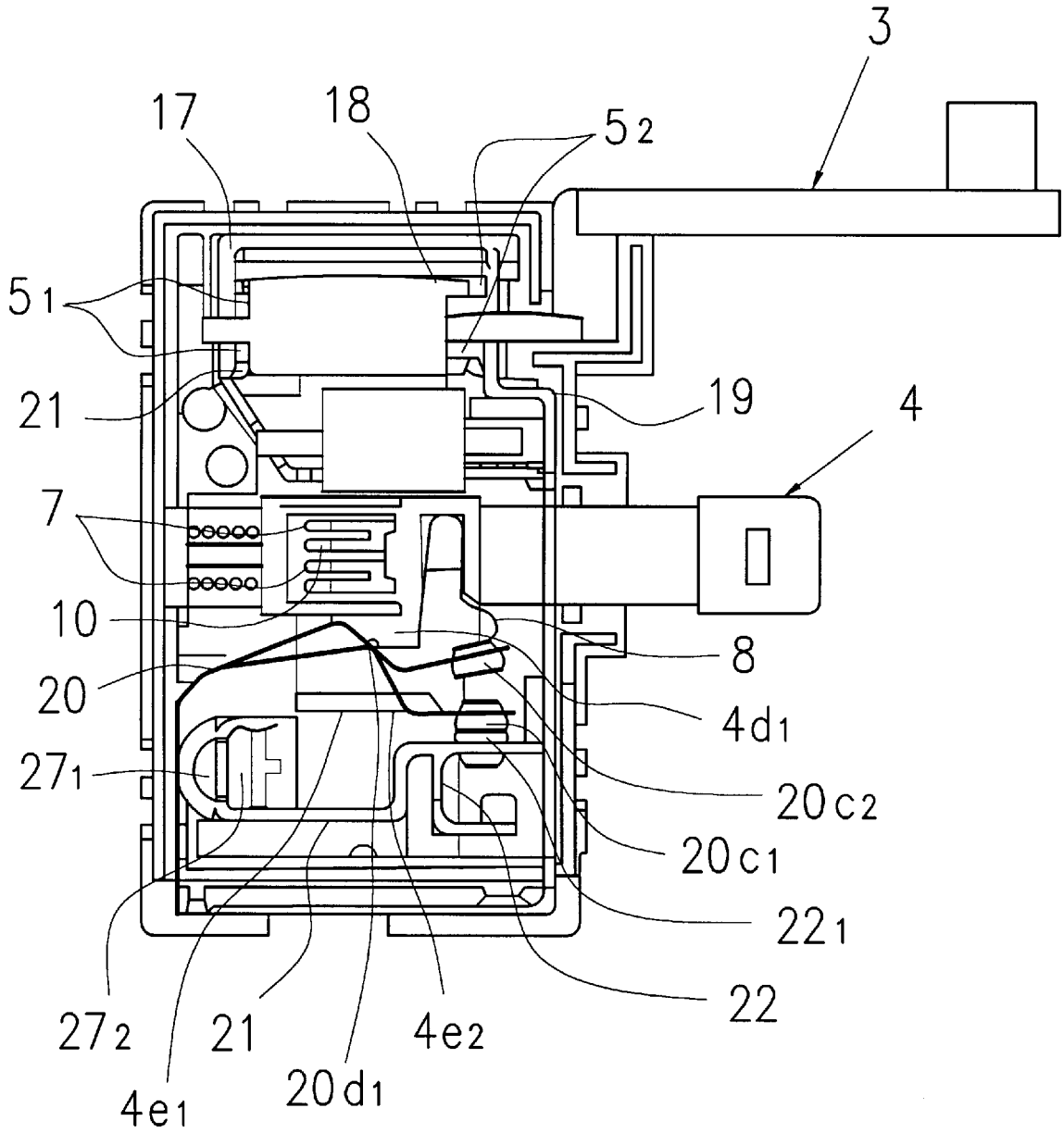
FIG. 16 is a side view corresponding to FIG. 2 and shows a state that the manipulation lever is further pulled.

If the manipulation lever is further pulled to move the manipulation shaft 4 from the position of FIG. 15, the first pressing portion $\mathbf{4}d_1$ under the plunger 4*a* of the manipulation shaft 4 pushes downward the touching portion $\mathbf{20}d_1$ of the first branch portion $\mathbf{20}b_1$ of the movable piece (second terminal) 20 as shown in FIG. 16, so that the first switch movable contact $\mathbf{20}c_1$ is brought into pressure contact with the first switch fixed contact $\mathbf{22}_1$ of the fourth terminal 22, to turn on the first switch 13. As a result, current flows from the DC power supply to the DC motor 2 to start normal rotation of a drill blade. The brush 10 which is mounted on the plunger 4*a* of the manipulation shaft 4 slides on the resistor of the circuit board 9 in accordance with the pulling stroke of the manipulation lever, and current corresponding to the sliding position is supplied to the DC motor 2 via the FET 12 for rotational speed control. Thus, the DC motor 2 rotates at a speed corresponding to the pulling stroke of the manipulation lever.

If the manipulation lever is further pulled to the full stroke, the second pressing portion $\mathbf{4}d_2$ under the plunger 4*a* of the manipulation shaft 4 pushes downward the touching portion $\mathbf{20}d_2$ of the second branch portion $\mathbf{20}b_2$ of the movable piece (second terminal) 20, so that the second switch movable contact $\mathbf{20}c_2$ is brought into pressure contact with the second switch fixed contact $\mathbf{21}_3$ of the third terminal 21, to turn on the second switch 14. As a result, the DC power supply is short-circuited with the DC motor 2, which therefore rotates at the maximum speed.

If the pulling manipulation on the manipulation lever is canceled, the manipulation shaft 4 is returned rightward as viewed in FIG. 16 together with the manipulation lever due to the urging force of the return spring 7, so that the pressing by the second pressing portion $\mathbf{4}d_2$ against the second branch portion $\mathbf{20}b_2$ of the movable piece 20 is canceled and the second switch movable contact $\mathbf{20}c_2$ is separated from the second switch fixed contact $\mathbf{21}_3$, to turn off the second switch 14. If the manipulation shaft 4 further returns, the pressing by the first pressing portion $4d_1$ against the first branch portion $20b_1$ of the movable piece 20 is canceled and the first switch movable contact $20c_1$ is separated from the first switch fixed contact $22_1$, to turn off the first switch 13. Thus, the current supply to the DC motor 2 is terminated. If the manipulation shaft 4 further returns, the brake terminal 8 which is mounted on the plunger 4*a* of the manipulation shaft 4 is brought into pressure contact with the braking fixed contact portions $19_1$ and $21_2$ of the first and third terminals 19 and 21, to turn on the brake switch 15. Thus, both ends of the DC motor 2 are short-circuited to brake it.

Where contacts of the first and second switches 13 and 14 are fuzed together, they are forcibly separated from each other by the separating portions $4e_1$ and $4e_2$ of the manipulation shaft 4 during its return movement.

The above operation is of the case of normal rotation. When a normal rotation state shown in FIG. 9C is selected past the neutral position of FIG. 9A, the changeover contact $5_1$ of the switching lever 3 connects the first fixed contact portion $17_1$ of the first motor terminal 17 to the first fixed contact portion $21_1$ of the third terminal 21 and the changeover contact $5_2$ connects the second fixed contact portion $18_2$ of the second motor terminal 16 to the second fixed contact portion $19_2$ of the first terminal 19. The DC motor 2 is rotated in the reverse direction in a manner similar to the manner of the normal rotation.

Embodiment 2

In the first embodiment, the resilient second terminal 20 is so urged that its movable contacts $20c_1$ and $20c_2$ are separated from the first switch fixed contact $22_1$ and second switch fixed contact $21_3$, respectively, in the free state where it is not pressed by the plunger 4*a* of the manipulation shaft 4. In contrast, in the second embodiment, in the free state a resilient second terminal 20 is so urged that its movable contacts $20c_1$ and $20c_2$ are in contact with the first switch fixed contact $22_1$ and second switch fixed contact $21_3$, respectively, as described below.

Figure 17:
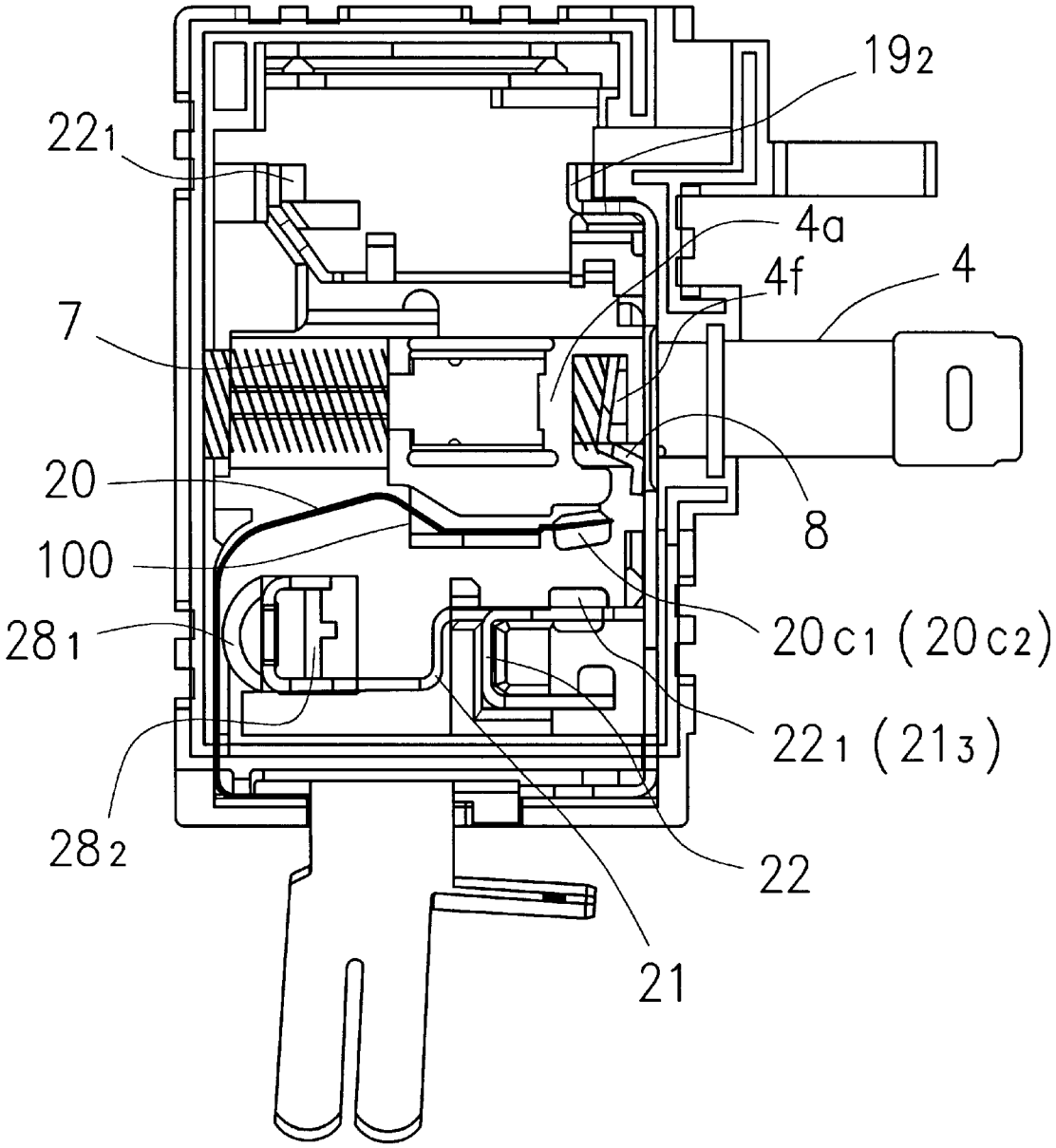
FIG. 17 is a side view corresponding to FIG. 2 and shows a trigger switch according to a second embodiment of the invention.
Figure 18:
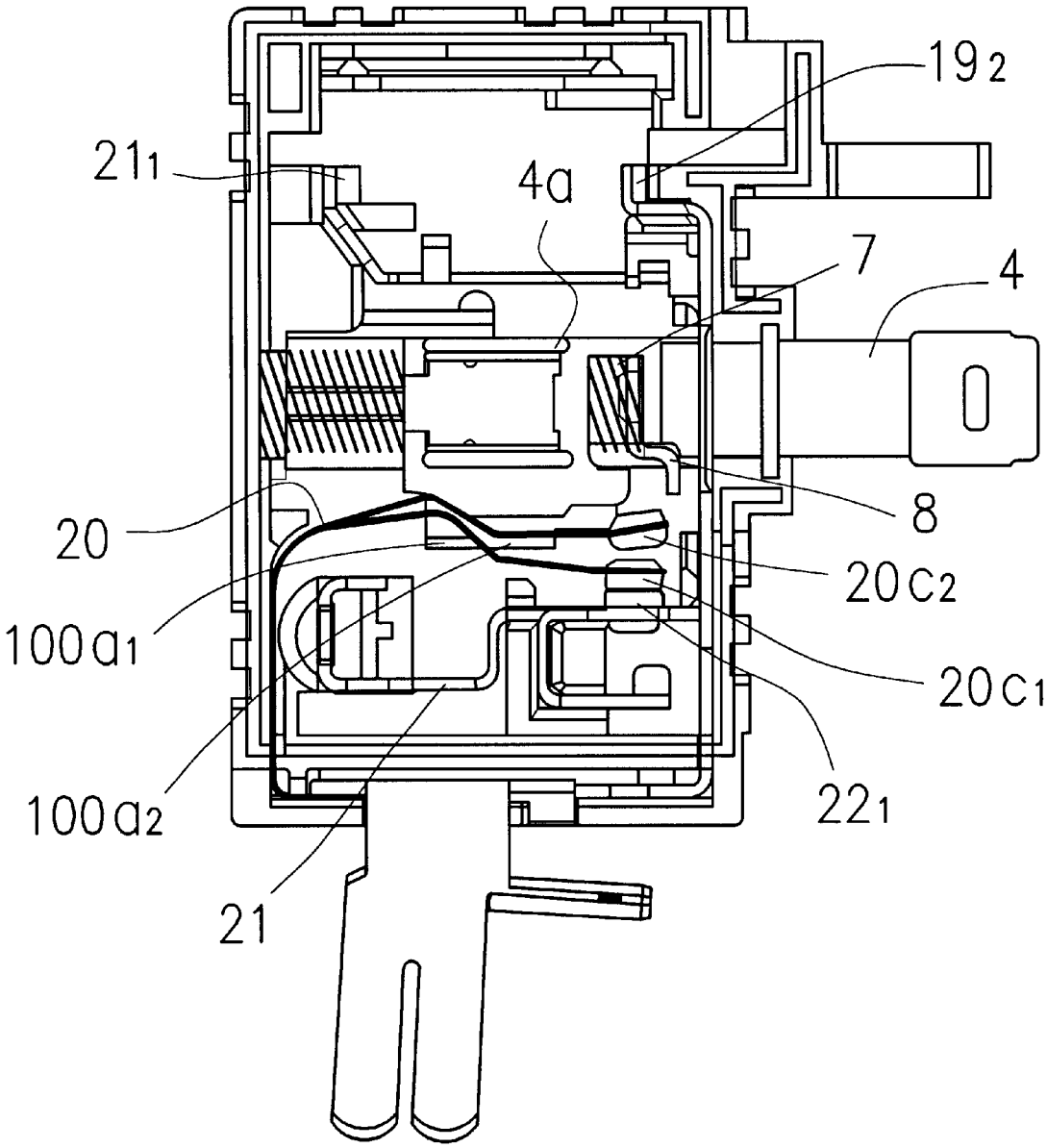
FIG. 18 is a side view corresponding to FIG. 17 and shows a state that the manipulation lever is pulled.
Figure 19:
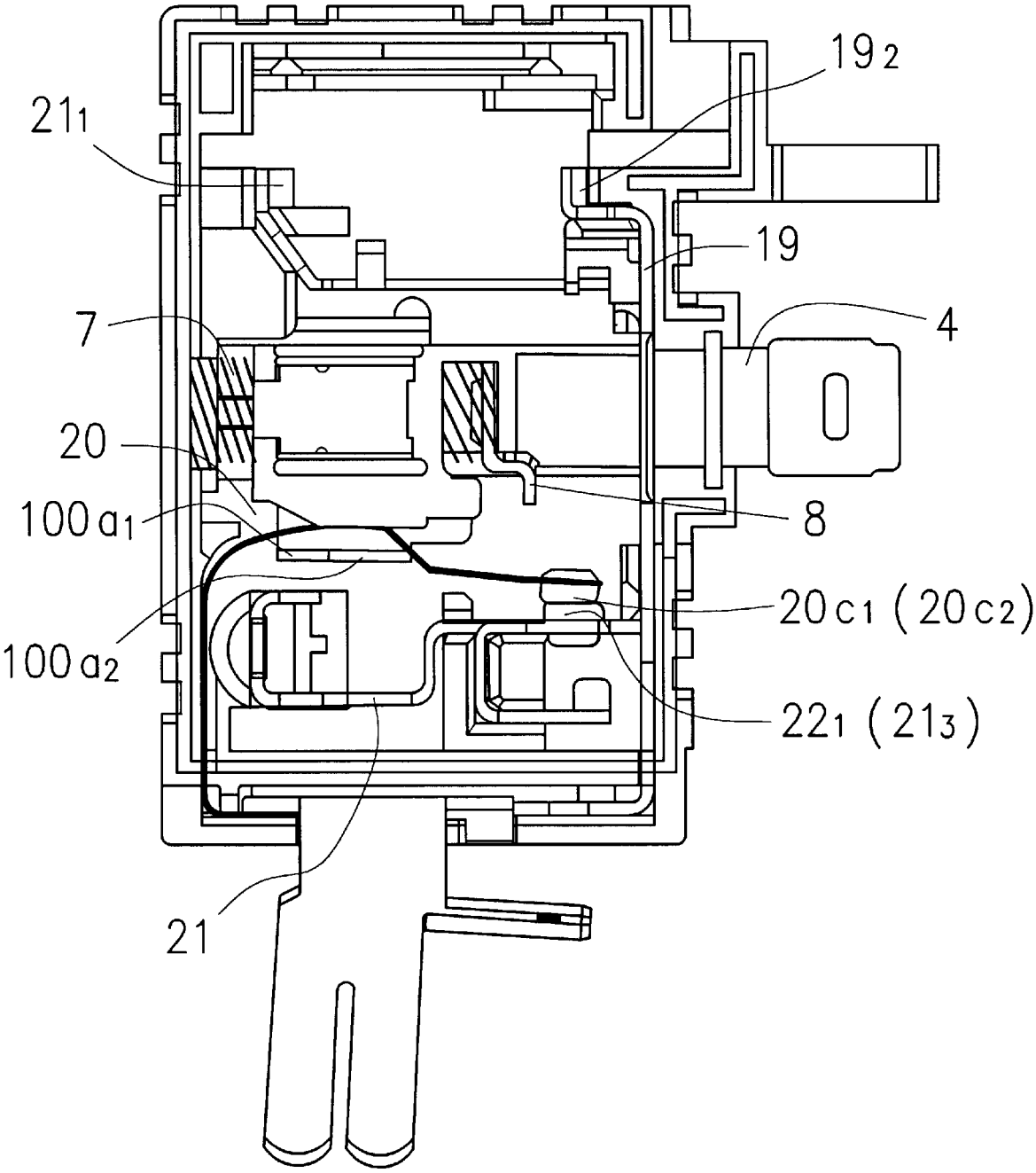
FIG. 19 is a side view corresponding to FIG. 17 and shows a state that the manipulation lever is further pulled.

FIG. 17, which corresponds to FIG. 2, shows a trigger switch according to the second embodiment of the invention. FIG. 18 shows a state that the first switch 13 in on as a result of a pulling manipulation on the manipulation lever. FIG. 19 shows a state that the second switch 14 is also on. In these figures, the switching lever, the motor terminals, etc. are omitted and the parts corresponding to those in the first embodiment are given the same reference symbols.

Figure 20:
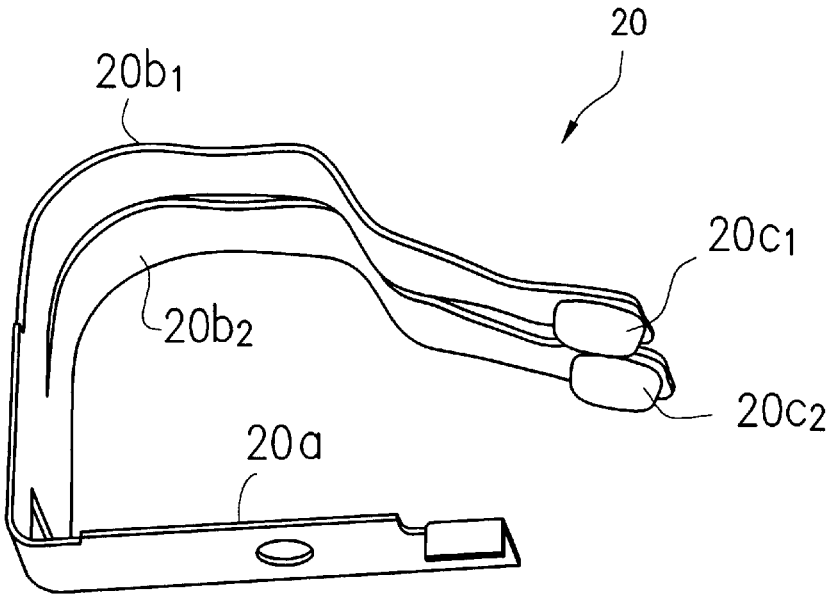
FIG. 20 is a perspective view of a movable piece.

In this embodiment, as shown in FIG. 20, the second terminal 20 is no shaped that free end portions of first and second branch portions $20b_1$ and $20b_2$ are more curved downward (toward the substrate portion 20*a*) than those in the first embodiment. When the second terminal 20 is disposed in the case in the free state, its urging force causes the first switch movable contact $20c_1$ and the second switch movable contact $20c_2$ to be brought into contact with the first switch fixed contact $22_1$ of the fourth terminal and the second switch fixed contact $21_3$ of the third terminal 21.

Figure 21:
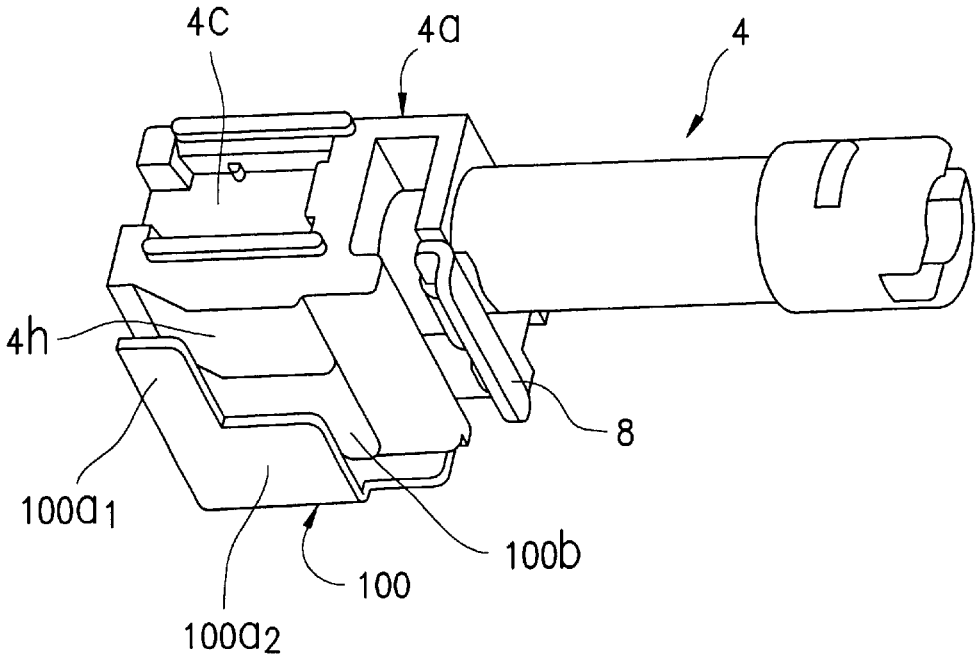
FIG. 21 is a perspective view of a manipulation shaft.
Figure 22:
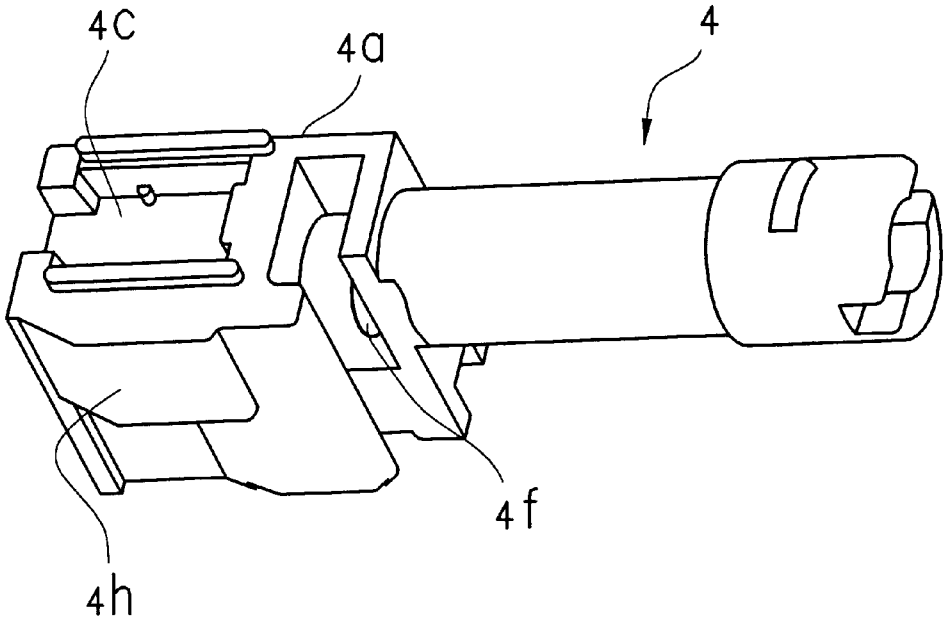
FIG. 22 is a perspective view of the main body of the manipulation shaft.
Figure 23:
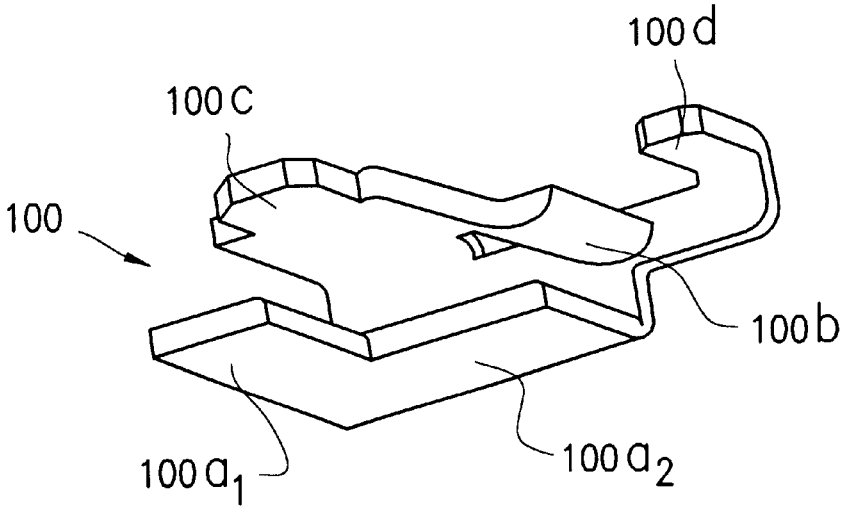
FIG. 23 is a perspective view of a holding plate.

On the other hand, as shown in FIG. 21, a manipulation shaft 4 has a plunger 4*a*, which has, at its bottom portion, a metal holding plate 100 for lifting and holding the first and second branch portions $20b_1$ and $20b_2$ of the second terminal 20 against its urging force. FIG. 22 shows a state that a terminal member (described later) of a brake terminal 8 is attached to the manipulation shaft 4. The manipulation shaft 4 is so configured that the holding plate 100 shown in FIG. 23 is press-fitted into the resin main body of the manipulation shaft 4. The holding plate 100 has first and second holding portions $100a_1$ and $100a_2$ for holding the first and second branch portions $20b_1$ and $20b_2$ of the second terminal 20, respectively, a pressing portion 100*b* opposed to the second holding portion $100a_2$ for pushing the second branch portion $20b_2$ to secure proper pressure (described later) and press-fitting portions 100*c* and 100*d* which are press-fitted in and held by the main body of the manipulation shaft 4.

At the free position shown in FIG. 17, both of the first and second branch portions $20b_1$ and $20b_2$ of the second terminal 20 are lifted and held by the holding plate 100 of the manipulation shaft 4, so that the movable contacts $20c_1$ and $20c_2$ are separated from the first switch fixed contact $22_1$ of the fourth terminal 22 and the second switch fixed contact $21_3$ of the third terminal 21, respectively. As the manipulation shaft 4 moves, the first and second holding portions $100a_1$ and $100a_2$ cancel the holding of the first and second branch portions $20b_1$ and $20b_2$ of the second terminal 20 to thereby sequentially bring the movable contacts $20c_1$ and $20c_2$ into contact with the first switch fixed contact $22_1$ of the fourth terminal and the second switch fixed contact $21_3$ of the third terminal 21, respectively.

The first and second holding portions $100a_1$ and $100a_2$ are formed at different positions in the movement direction of the manipulation shaft 4 so as to turn on the first switch when the manipulation lever is pulled to the first manipulation position of FIG. 18, and then turn on the second switch 14 when the manipulation lever is pulled to the second, i.e., maximum, manipulation position of FIG. 19. The first and second holding portions $100a_1$ and $100a_2$ correspond to the first and second pressing portions $4d_1$ and $4d_2$ in the first embodiment, respectively.

An described above, the first switch movable contact $20c_1$ and the second switch movable contact $20c_2$ are brought into contact with the first switch fixed contact $22_1$ of the fourth terminal 22 and the second switch fixed contact $21_3$ of the third terminal 21 by the resilient force of the second terminal 20 when the lifting and holding of the first and second branch portions $20b_1$ and $20b_2$ of the second terminal 20 by the holding plate 100 which is attached to the plunger 4*a* of the manipulation shaft 4 are canceled. Therefore, compared to the first embodiment in which the first switch movable contact $20c_1$ and the second switch movable contact $20c_2$ are pressed against the first switch fixed contact $22_1$ of the fourth terminal 22 and the second switch fixed contact $21_3$ of the third terminal 21 by causing the plunger 4*a* of the manipulation shaft 4 to push the first and second branch portions $20b_1$ and $20b_2$ against the resilient force of the second terminal 20, the pressing amount of the manipulation shaft 4 can be reduced and hence the operation can be made faster. Further, the second terminal 20 (movable piece) can be prevented from being deformed excessively.

Also in this embodiment, to increase the contact pressure exerted on the first switch fixed contact $22_1$ and the second switch fixed contact $21_5$ from the first switch movable contact $20c_1$ and the second switch movable contact $20c_2$ of the second terminal 20, the first and second branch portions $20b_1$ and $20b_2$ of the second terminal 20 are pushed by a pressing portion 4*h* which is a bottom face of the plunger 4*a* of the manipulation shaft 4 and the above-mentioned pressing portion 100*b*, respectively. In particular, a large current flowing through the second switch 14 which short-circuits the DC power supply with the DC motor 2 generates heat therein. However, since the pressing portion 100*b* for pushing the second switch movable contact $20c_2$ of the second switch 14 is a metal plate, it is superior in heat resistance to resin.

Figure 24:
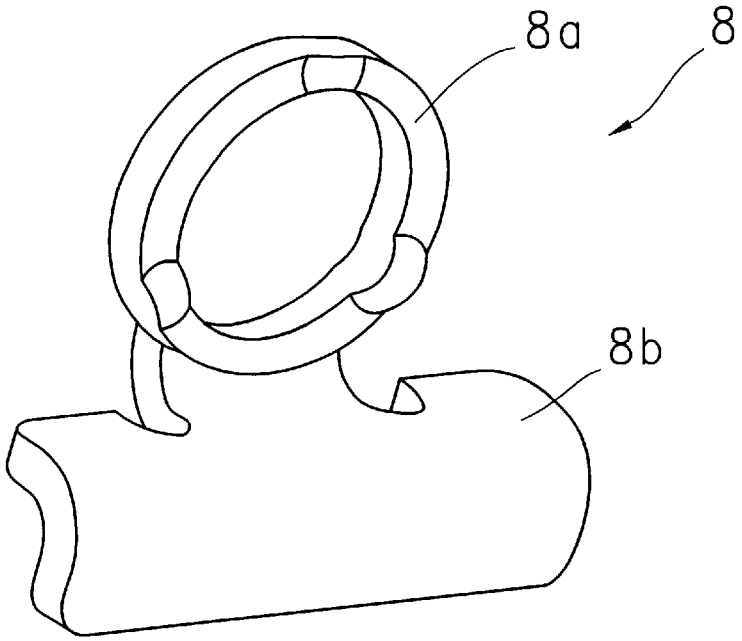
FIG. 24 is a perspective view of a brake terminal.
Figure 25:
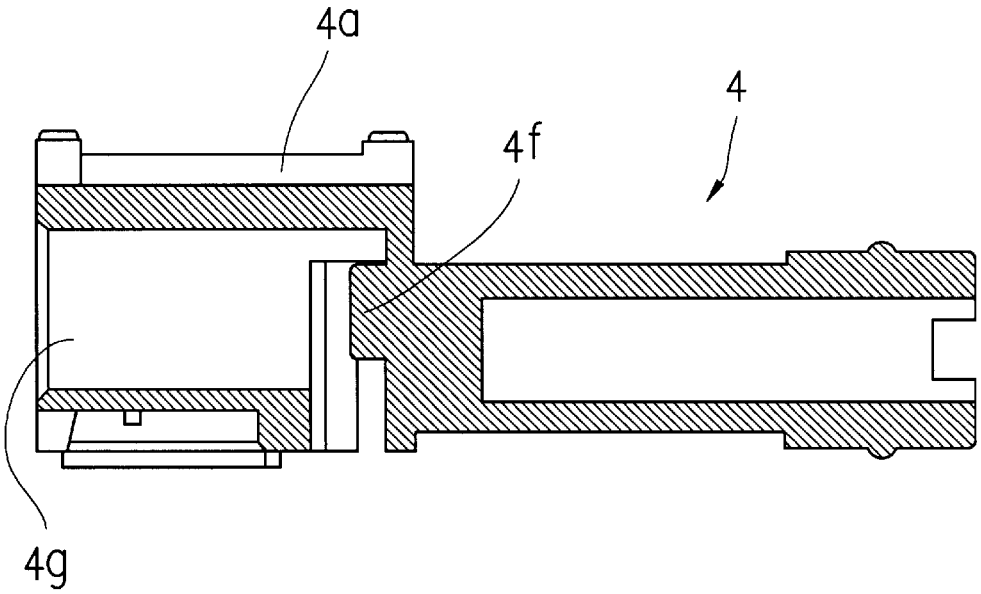
FIG. 25 is a sectional view of the main body of the manipulation shaft.

While in the first embodiment the brake terminal 8 is a single leaf spring, in this embodiment it is a terminal member shown in FIG. 24, which consists of an annular fixing portion 8*a* which is to hold an inserted boas 4*f* of the manipulation shaft 4 and a bent contact portion 8*b* extending from the fixing portion 8*a* which is to be brought into contact with or separated from the braking fixed contact portions $\mathbf{19}_1$ and $\mathbf{21}_2$ of the first and third terminals 19 and 21. The terminal member is so configured that the fixing portion 8*a* is held by the inserted boss 4*f* of the main body of the manipulation shaft 4. (see FIG. 25) and the contact portion 8*b* is pressed against the braking fixed contact portions $\mathbf{19}_1$ and $\mathbf{21}_2$ of the first and third terminals 19 and 21 by the return spring 7 which is inserted in a through-hole 4*g* of the plunger 4*a* of the main body of the manipulation shaft 4. That is, in this embodiment, the return spring 7 also provides the urging force of the leaf spring used in the first embodiment.

In this embodiment, at the free position where the manipulation lever is not pulled at all, the contact portion 8*b* of the brake terminal 8 is pressed against the braking fixed contact portions $\mathbf{19}_1$ and $\mathbf{21}_2$ of the first and third terminals 19 and 21 by the urging force of the return spring 7 which urges the manipulation shaft 4, as shown in FIG. 17. In this state, the fixing portion 8*b* of the brake terminal 8 is pressed against the boss 4*f* to have a slanted return posture. If the manipulation lever is pulled from the free position against the urging force of the return spring 7, the fixing portion 8*a* changes its posture from the slanted return posture to a manipulated posture that is perpendicular to the boss 4*f* as shown in FIG. 18. The time taken by the transition from the return posture to the manipulated posture provides a play stroke of the manipulation lever. After this play pulling stroke, the brake terminal 8 is separated from the fixed contact portions $\mathbf{19}_1$ and $\mathbf{21}_2$.

Since the brake terminal 8 is the terminal member rather than a leaf spring, the contact portion can be made sufficiently thick to accommodate consumption of the contacts due to arcing etc.

To improve the sense of clicking of the normal/reverse rotation switching lever, the following measure is employed in this embodiment.

Figure 26:
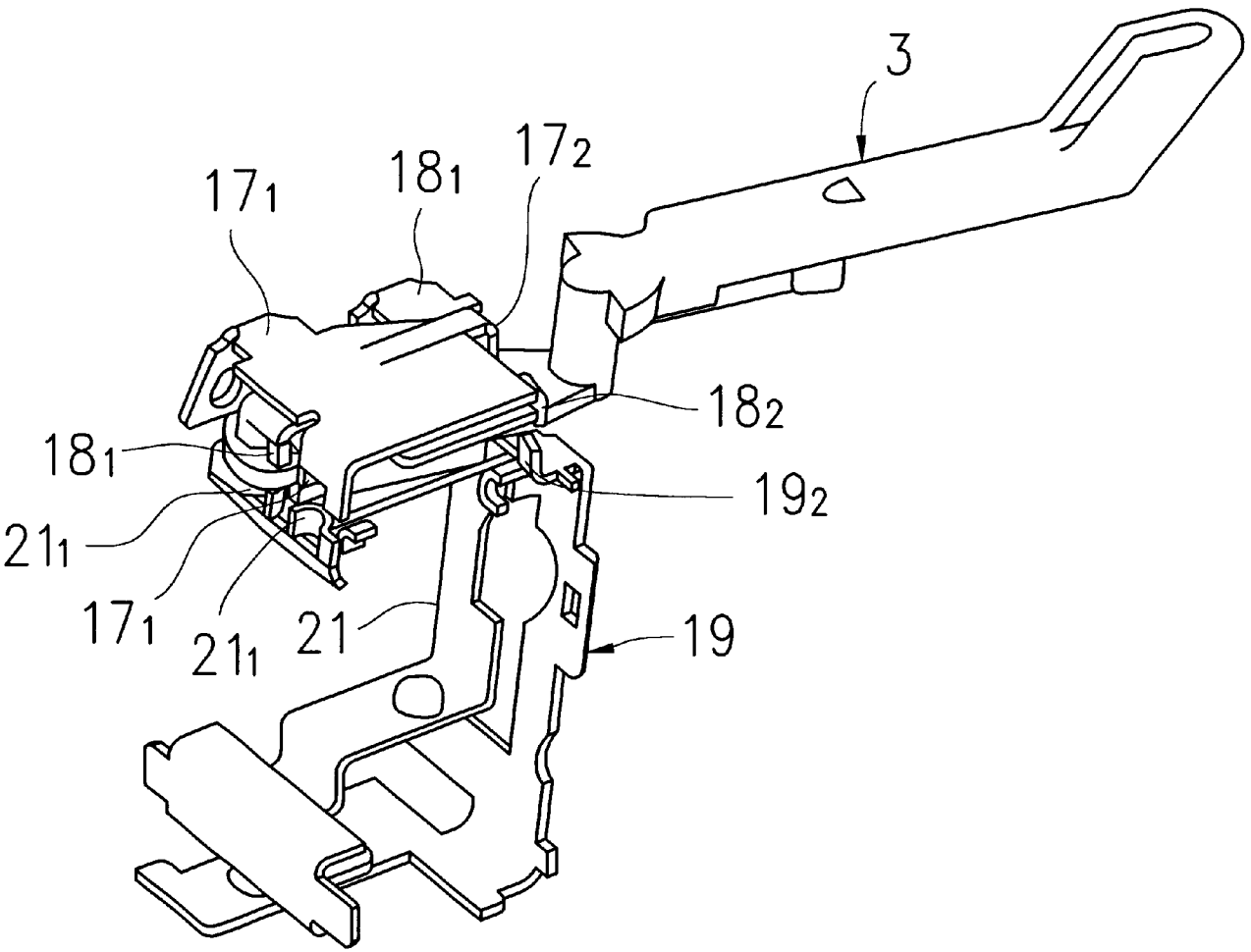
FIG. 26 is a perspective view showing the arrangement of terminals and a switching lever.
Figure 27:
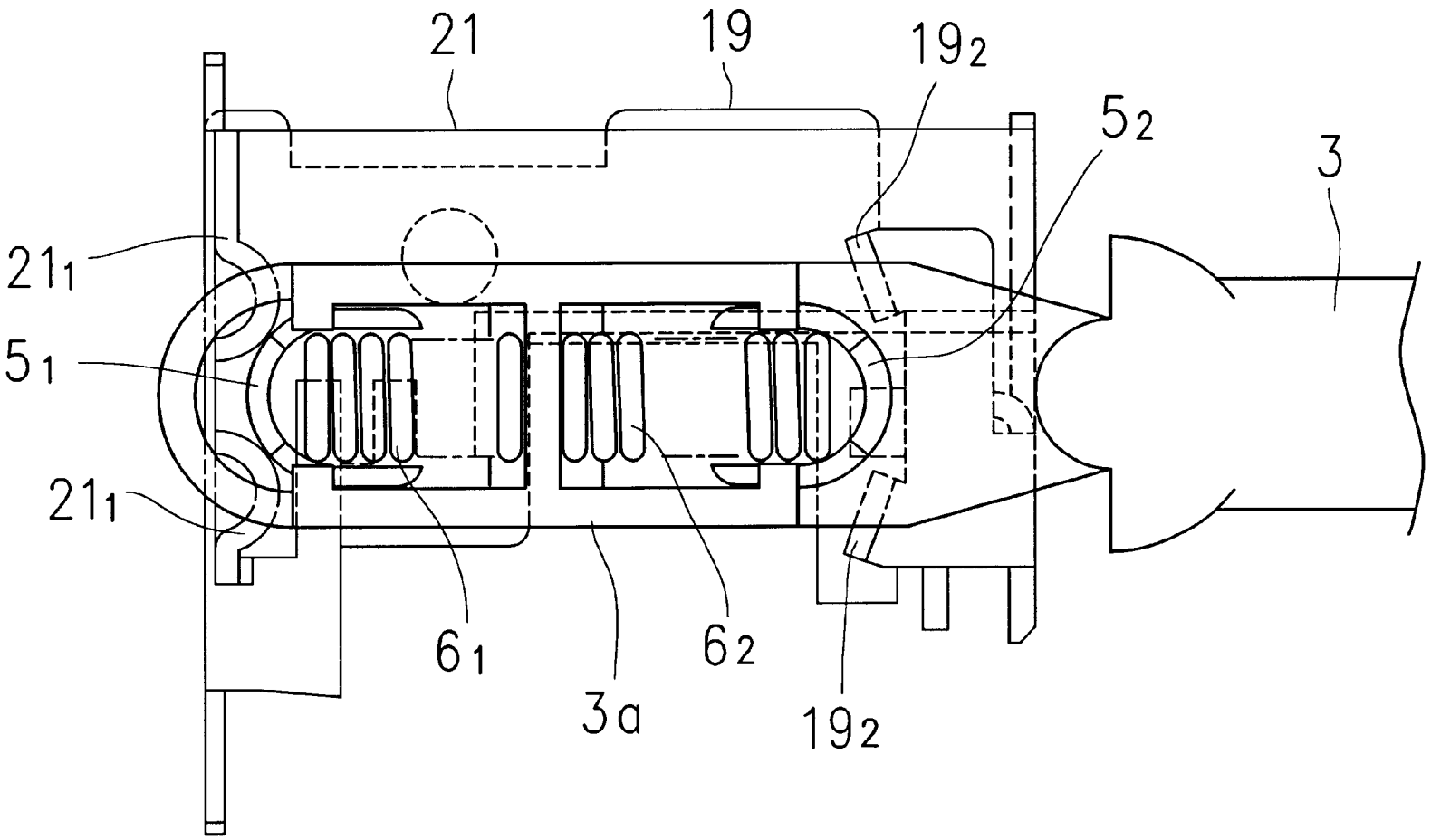
FIGS. 27 and 28 show contact portions in a neutral state and a normal rotation state, respectively.
Figure 28:
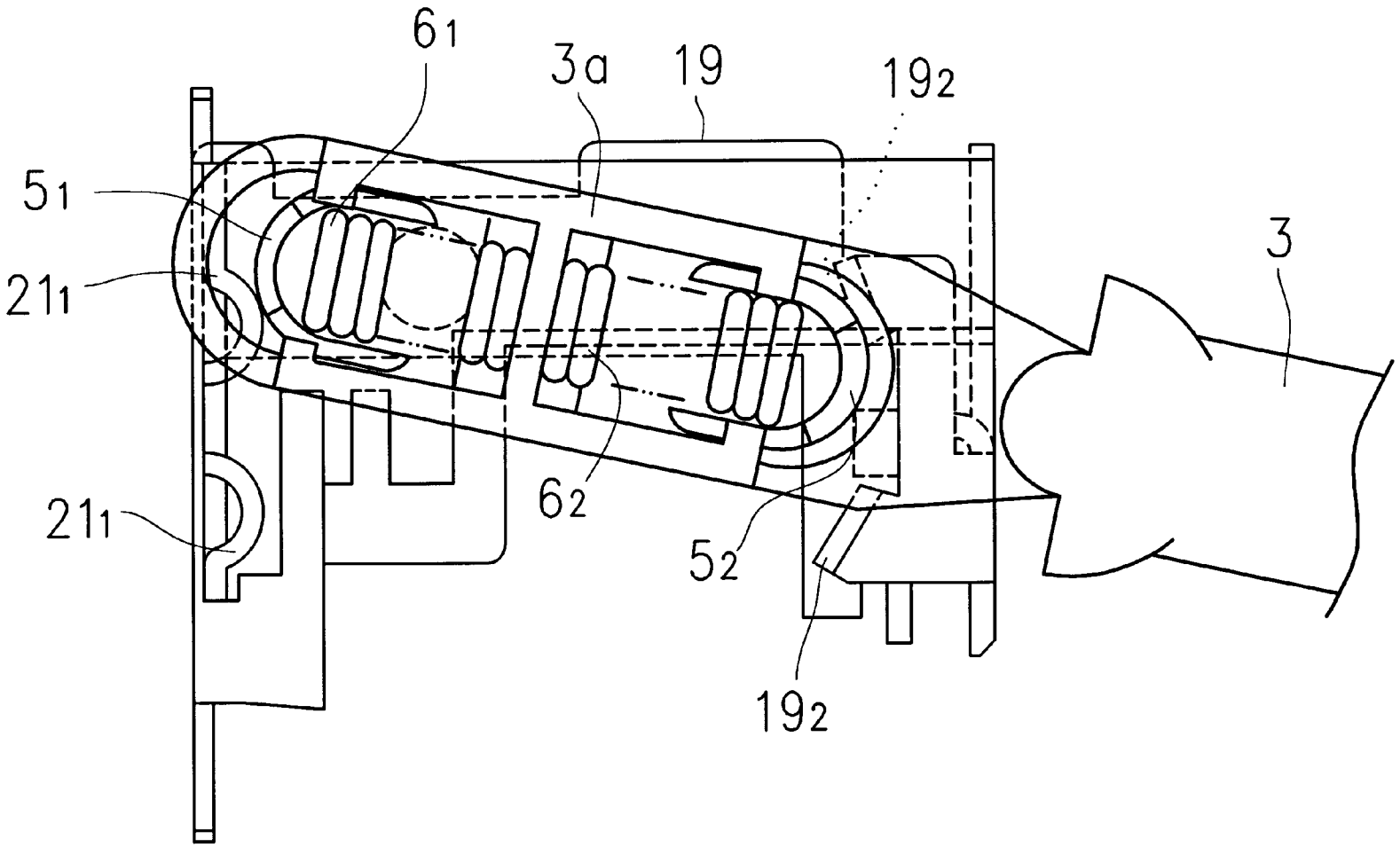
Figure 29:
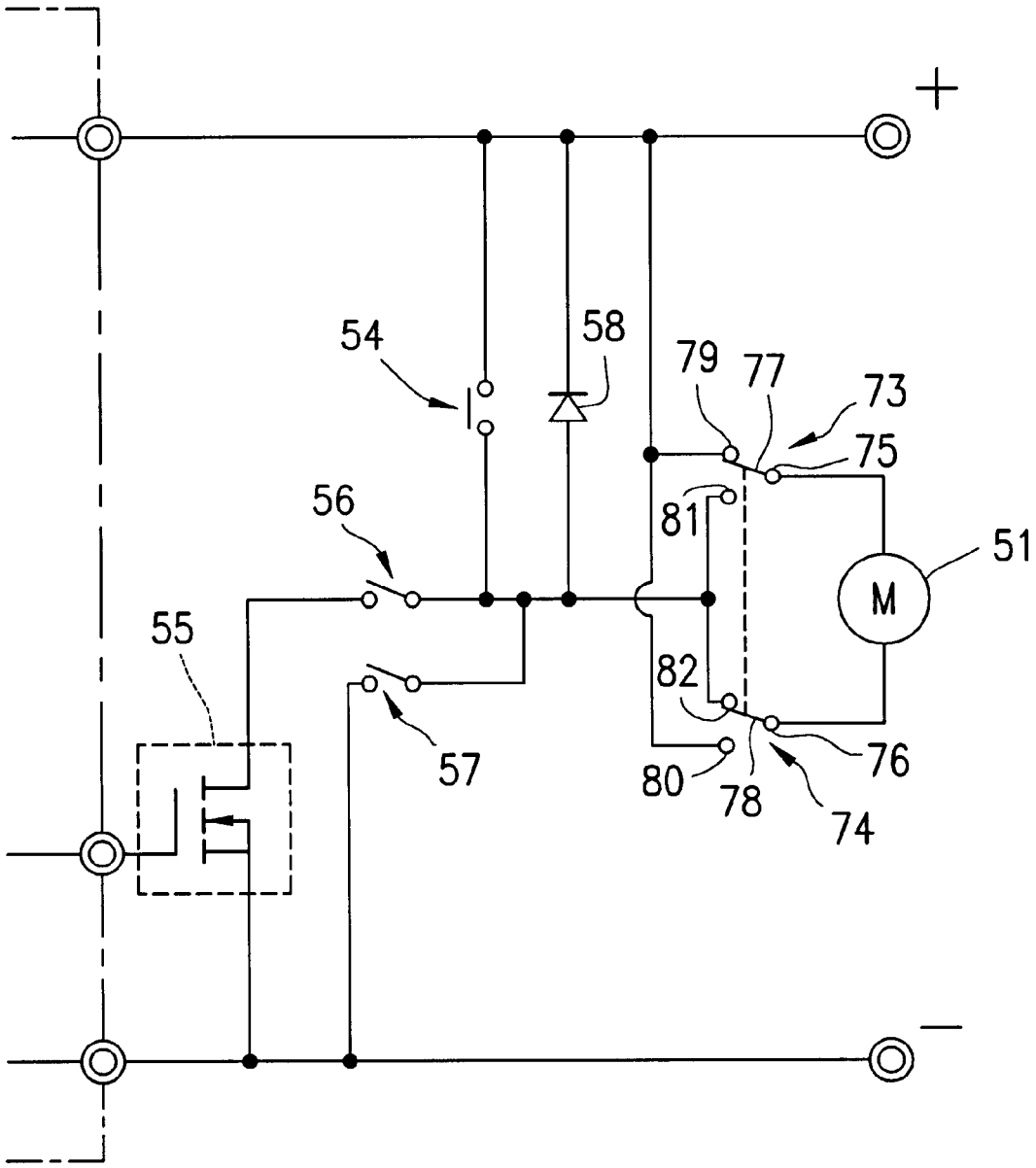
FIG. 29 PRIOR ART
FIG. 29 shows a circuit configuration of a conventional trigger switch.

FIG. 26 is a perspective view showing the arrangement of the first and second motor terminals 17 and 18, the first and third terminals 19 and 21, and the switching lever 3. FIGS. 27 and 28 are plan views of contact portions in a neutral state and a normal rotation state, respectively. The parts corresponding to those in the first embodiment are given the same reference symbols.

In this embodiment, first fixed contact portions $\mathbf{17}_1$ and $\mathbf{18}_1$ of the first and second motor terminals 17 and 18 and two first fixed contact portions $\mathbf{21}_1$ of the third terminal 21 with or from which a first changeover contact $\mathbf{5}_1$ of the switching lever is to be brought into contact or separated have circular-arc-shaped convex portions which project to the first changeover contact $\mathbf{5}_1$ side. In returning to the neutral state, as shown in FIGS. 27 and 28, the first changeover contact $\mathbf{5}_1$ of the switching lever 3 goes over the circular-arc-shaped convex portion and then goes into a gap between the adjacent first fixed contact portions $\mathbf{17}_1$ and $\mathbf{18}_1$ of the first and second motor terminals 17 and 18 and a gap 24 between the adjacent first fixed contact portions $\mathbf{21}_1$ of the third terminal 21. This engagement operation provides a sufficient sense of clicking.

Further, in this embodiment, the surfaces of second fixed contact portions $\mathbf{17}_2$ and $\mathbf{18}_2$ of the first and second motor terminals 17 and 18 and the surfaces of two fixed contact portions $\mathbf{19}_2$ of the first terminal 19 with or from which a second changeover contact $\mathbf{5}_2$ of the switching lever 3 is to be brought into contact or separated are inclined from the perpendicular to the manipulation direction (right-left direction in FIG. 27) of the manipulation shaft 4 rather than formed perpendicularly to the manipulation direction as in the first embodiment. At the neutral position shown in FIG. 27, the second changeover contact $\mathbf{5}_2$ of the switching lever 3 does not contact the second fixed contact portions $\mathbf{17}_2$ and $\mathbf{18}_2$ of the first and second motor terminals 17 and 18 or the two second fixed contact portions $\mathbf{19}_2$ of the first terminal 19. At the reverse rotation position or the normal rotation position shown in FIG. 28, the second changeover contact $\mathbf{5}_2$ of the switching lever 3 is brought into contact with the second fixed contact portion $\mathbf{17}_2$ of the first motor terminal 17 and one of the two second fixed contact portions $\mathbf{19}_2$ of the first terminal 19 or the second fixed contact portion $\mathbf{18}_2$ and the other second fixed contact portion $\mathbf{19}_2$.

As described above, at the neutral position, the second changeover contact $\mathbf{5}_2$ of the switching lever 3 is separated from the second fixed contact portions $\mathbf{17}_1$ and $\mathbf{18}_2$ of the first and second motor terminals 17 and 18 and the two second fixed contact portions $\mathbf{19}_2$ of the first terminal 19. Therefore, current never flows even if the manipulation lever is handled roughly at the neutral position.

As another embodiment of the invention, the normal/reverse rotation switching contact portions may be configured in the following manner. Second fixed contact portions $\mathbf{17}_2$ and $\mathbf{18}_2$ of the first and second motor terminals 17 and 18 and two second fixed contact portions $\mathbf{19}_2$ of the first terminal 19 are formed into convex portions for providing a sense of clicking. On the other hand, first fixed contact portions $\mathbf{17}_1$ and $\mathbf{18}_1$ of the first and second motor terminals 18 and 18 and two first fixed contact portions $\mathbf{21}_1$ of the third terminal 21 are inclined so as to be separated from the first changeover contact $\mathbf{5}_1$ of the switching lever 3 at the neutral position.

As described above, according to the switching device of the invention, the movable contacts of the first and second switch are constructed by making a single, resilient movable piece branch off. Therefore, compared to the conventional device in which the corresponding portion is composed of five parts, i.e., two movable pieces, two coil springs for urging the respective movable pieces, and a terminal board for connecting and supporting the movable pieces, the number of parts is reduced and the ease of assembling is improved, whereby the cost can be reduced greatly.

The manipulation member separates the movable contacts from the fixed contacts by holding the first and second branch portions, respectively, against the resilient force of the movable piece. The manipulation member allows the movable contacts to contact the fixed contacts by canceling the holding at different manipulation positions of the manipulation lever. Therefore, the pulling amount of the manipulation lover can be reduced as compared to the configuration in which the movable contacts are brought into contact with the fixed contacts by pushing the first and second branch portions.

According to the switching device of the invention, the braking movable contact is constituted of a single resilient member or a single terminal member which is urged by the urging means for return-urging the manipulation lever. Therefore, compared to the conventional device in which the corresponding portion is constituted of two parts, i.e., a movable contact and a coil spring for urging the movable contact, the number of parts is reduced and the ease of assembling is improved, whereby the cost can further be reduced.

According to the switching device of the invention, the manipulation member has the separating portion. Therefore, even if contact portions of the first and/or second switches are fused together, they can forcibly be separated from each other in a return movement of the manipulation member.

Further, according to the switching device of the invention, the first fixed contact portions with or from which the first changeover contact portion of the switching lever for switching between normal rotation and reverse rotation is brought into contact or separated, or the second fixed contact portions with or from which the second changeover contact portion is brought into contact or separated perform an engagement operation with the changeover contact portion. Therefore, a sufficient sense of clicking can be obtained when the switching lever rotates.

The first or second fixed contact portions which do not perform an engagement operation are so disposed as to be separated from the first and second changeover contact portions of the switching lever at the neutral position. Therefore, current never flows through the load even if the manipulation lever is manipulated at the neutral position.

What is claimed is:

1. A switch device comprising:

a first switch for connecting a power supply to a load via a load control element in accordance with a first manipulation position on a single unit manipulation member, a second switch for connecting the power supply to the load not via the load control element in accordance with a second manipulation position on the manipulation member, a single, resilient movable piece having respective movable contacts of the first and second switches on a same end of the movable piece, the manipulation member bringing the movable contacts into contact with corresponding fixed contacts, respectively, wherein the movable piece further has first and second branch portions on which the movable contacts of the first and second switches are provided, and wherein the manipulation member has first and second pressing portions for separating the movable contacts from the respective fixed contacts by pushing the first and second portions, respectively, against a resilient force of the movable piece, the first and second pressing portions allowing the movable contacts to contact the respective fixed contacts at different manipulation positions of the manipulation member.

2. The switching device according to claim 1, wherein the first pressing portion causes the movable contact on the first branch portion to start contacting the corresponding fixed contact when the manipulation member is manipulated to a first manipulation position, and causes the movable contact on the second branch portion to start contacting the corresponding fixed contact when the manipulation member is further manipulated to a second manipulation position.

3. The switching device according to claim 1, wherein the manipulation member has first and second pressure increasing portions for increasing contact pressure of the movable contacts being in contact with the respective fixed contacts by pushing the first and second branch portions, respectively.

4. A switching device comprising:

a first switch for connecting a power supply to a load via a load control element in accordance with a first manipulation position on a single unit manipulation member;

a second switch for connecting the power supply to the load not via the load control element in accordance with a second manipulation position on the manipulation member;

a single, resilient movable piece having respective movable contacts of the first and second switches on a same end of the movable piece;

a brake switch having a braking movable contact which is constituted of a single member incorporated in the manipulation member, for short-circuiting both terminals of the load; and urging means for return-urging the manipulation lever in a direction opposite to a manipulation direction at an initial position where the manipulation member is not manipulated, to thereby bring the braking movable contact into pressure-contact with a corresponding braking fixed contact.

5. The switching device in accordance with claim 4, wherein the braking movable contact is supported swingably and makes a transition in accordance with a third manipulation position on the manipulation member from a return posture in which the braking movable contact is in pressure contact with the braking fixed contact to a manipulated posture in which it is separated from the braking fixed contact.

* * * * *